US010441088B2

(12) United States Patent
Robins et al.

(10) Patent No.: US 10,441,088 B2
(45) **Date of Patent: *Oct. 15, 2019**

(54) ADJUSTABLE MATTRESS USING INSERTED WANDS

(71) Applicant: Brobard, LLC, Houston, TX (US)

(72) Inventors: John A. Robins, Houston, TX (US); Brent Ford, Houston, TX (US); Rosa Ortiz, Houston, TX (US)

(73) Assignee: Brobard, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/137,754

(22) Filed: Sep. 21, 2018

(65) Prior Publication Data

US 2019/0125096 A1 May 2, 2019

Related U.S. Application Data

(63) Continuation of application No. 15/802,123, filed on Nov. 2, 2017, now Pat. No. 10,104,983.

(51) Int. Cl.

| | |
|---|---|
| ***A47C 27/14*** | (2006.01) |
| ***A47C 27/15*** | (2006.01) |
| ***A47C 31/10*** | (2006.01) |
| ***A47C 27/00*** | (2006.01) |
| ***A47C 31/00*** | (2006.01) |
| ***A47C 27/16*** | (2006.01) |
| ***A47C 27/20*** | (2006.01) |

(52) U.S. Cl.

CPC ..... *A47C 27/144* (2013.01); *A47C 27/002* (2013.01); *A47C 27/146* (2013.01); *A47C 27/148* (2013.01); *A47C 27/15* (2013.01); *A47C 27/16* (2013.01); *A47C 27/20* (2013.01); *A47C 31/001* (2013.01); *A47C 31/105* (2013.01)

(58) Field of Classification Search

CPC ..... A47C 27/00; A47C 27/002; A47C 27/14; A47C 27/142; A47C 27/144; A47C 27/148; A47C 27/15; A47C 31/001; A47C 31/00; A47C 31/105

USPC .... 5/727, 728, 690, 740, 953, 483, 698, 954

See application file for complete search history.

(56) References Cited

U.S. PATENT DOCUMENTS

| | | | |
|---|---|---|---|
| 3,110,042 | A | 11/1963 | Slemmons |
| 3,534,417 | A | 10/1970 | Boyles |
| 4,161,045 | A | 7/1979 | Regan |
| 4,463,464 | A | 8/1984 | Bost et al. |

(Continued)

FOREIGN PATENT DOCUMENTS

| | | | |
|---|---|---|---|
| CA | 2935633 | A1 | 7/2015 |
| FR | 2720245 | A1 | 12/1995 |

(Continued)

*Primary Examiner* — Robert G Santos

(74) *Attorney, Agent, or Firm* — Norton Rose Fulbright US LLP

(57) ABSTRACT

Embodiments of a mattress and methods of manufacturing the same, wherein the mattress includes a body having one or more openings for removable inserts that a user can position within the openings to adjust the mechanical characteristics of the mattress, including the amount and location of support provided by the mattress to the user. Some embodiments of the mattress include one or more covers, such as a fire-retardant cover, that can encompass the mattress body while still allowing a user to access the openings of mattress body.

18 Claims, 19 Drawing Sheets

(56) References Cited

U.S. PATENT DOCUMENTS

| | | | | |
|---|---|---|---|---|
| 4,504,990 | A | 3/1985 | Scales et al. | |
| 4,706,313 | A | 11/1987 | Murphy | |
| 4,829,614 | A | 5/1989 | Harper | |
| 4,916,765 | A | 4/1990 | Castronovo, Jr. | |
| 5,533,218 | A | 7/1996 | Fahy | |
| 5,682,633 | A | 11/1997 | Davis | |
| 5,926,879 | A | 7/1999 | Davis | |
| 6,061,856 | A | 5/2000 | Hoffmann | |
| 6,823,546 | B1 | 11/2004 | Hsu | |
| 7,036,173 | B2 | 5/2006 | Gladney | |
| 7,424,763 | B2 | 9/2008 | Gladney | |
| 7,520,012 | B2 | 4/2009 | Robins | |
| 8,918,935 | B2 | 12/2014 | Gladney | |
| 9,211,017 | B2 | 12/2015 | Tyree | |
| 9,756,951 | B1 | 9/2017 | Stewart, Jr. | |
| 10,104,983 | B1 * | 10/2018 | Robins | A47C 31/001 |
| 2001/0029630 | A1 | 10/2001 | Cortese et al. | |
| 2006/0236462 | A1 | 10/2006 | Boyd | |
| 2014/0033440 | A1 | 2/2014 | Tyree | |
| 2019/0125096 | A1 * | 5/2019 | Robins | A47C 31/001 |

FOREIGN PATENT DOCUMENTS

| | | | |
|---|---|---|---|
| JP | 2013240479 | A | 12/2013 |
| NL | 1035854 | C | 3/2010 |

* cited by examiner

ADJUSTABLE MATTRESS USING INSERTED WANDS

CROSS-REFERENCE TO RELATED APPLICATIONS

This application is a continuation of U.S. patent application Ser. No. 15/802,123 filed on Nov. 2, 2017, now U.S. Pat. No. 10,104,983, and entitled "Adjustable Mattress Using Inserted Wands," which is hereby incorporated by reference.

FIELD OF DISCLOSURE

The present disclosure relates to mattresses and methods of manufacturing mattresses, and particularly to user-adjustable mattresses and method of manufacturing the same.

BACKGROUND

Historically, mattresses have used metallic springs encased in layers of upholstery to support and distribute the weight of a user. One alternative to spring-based mattresses are mattresses with layers of foam that accomplish the same purpose of supporting the user. Another alternative is air-filled or water-filled chambers or bladders in a supporting structure. An advantage of air-filled type mattresses is that a user can operate an air pump to adjust the amount of air in the chamber to adjust the support provided by the mattress.

SUMMARY

Each of the above mattress types has benefits and drawbacks. Some benefits of a foam mattress are ease of and low cost of manufacture, as well as durability of the mattress after manufacture, in part because of the lack of moving parts. A primary benefit of an air-type mattress is the adjustable amount of support to configure the mattress as firm or soft. This benefit of air-type mattresses comes with some significant drawbacks. An air-type mattress is generally difficult and expensive to manufacture and may break or require maintenance, in part because of the changing air chamber(s) and the pumps required to fill such chambers.

An adjustable foam (or other material) mattress can combine the benefits of foam mattresses with the benefits of air-type mattresses. The adjustability may be provided in a foam or other material (e.g., gel or plastic) mattress with a body having user-accessible openings with removable inserts (also referred to as "wands") to adjust the amount and location of support to a user without the use of pumps, air chambers, or other complex parts. This adjustable mattress provides a mattress that can be easily manufactured at a low cost, that is durable (e.g., long lasting, easier to transport), and that permits a user to adjust the amount of provided support to a desired level and at desired locations. Additionally, unlike typical air-type mattresses, adjustable foam (or gel or plastic) mattresses may not require electricity to adjust the amount of support they provide to a user.

In some embodiments of the disclosed mattresses, the openings are located on the sides or ends of the body of the mattress with no portion extending through the top or bottom of the body. In such a configuration, a user can slide a desired number and type of removable inserts into and out of the openings without having to move or adjust any portion of the body of the mattress (other than the removable inserts) or at least any portion of the body of the mattress that a user directly rests upon. This configuration reduces the risk of user error when positioning the removable inserts, as well as the risk of user-caused damage to the mattress body.

In some embodiments, the body of the mattress is comprised of multiple layers made from, for example, foam, gel, and/or plastic, each having different mechanical characteristics, such as strength, stiffness, density, and thermal conductivity. In some of these embodiments, the lower layer(s) may be comprised of more stiff materials (i.e., "foundation layer(s)") and include the openings for receiving the removable inserts. The relative stiffness of these foundation layers can permit the openings to better retain their shape, allowing easy positioning and removal of the removable inserts from the openings. Alternatively or additionally, the openings can be positioned in other layers of the mattress body. The exposed inner surface of the openings (i.e., the surface that mates with the removable inserts) can also be configured to provide less resistance (e.g., friction) when inserting or removing a removable insert by, for example, lining such exposed interior surface with low friction materials such as plastic or by melting plastic fibers, if any, in the foam, gel, and/or plastic immediately surrounding the opening.

The removable inserts also have different mechanical characteristics, such and strength and stiffness, and can be made from a variety of materials, including plastic and/or plastic-encased foam, polyethylene, or other materials. The mechanical characteristics of the removable inserts may be different than the mechanical characteristics of the material of the layer(s) so that positioning such removable inserts within the openings of such layer(s) alters the amount of support provided to a user at the location of the removable insert. For example, removable inserts having a greater stiffness than the layer(s) may be positioned substantially vertically below the location of a user's hips or back within the body of the mattress to provide greater support to those parts of the user's body.

In some embodiments, a single opening may extend across an entire end or side of the body of the mattress to receive a single removable insert. In such a configuration, the adjustment provided by the removable insert will be uniform at the location of the opening across such end or side.

The opening can also receive more than one removable insert (i.e., if the removable inserts are less than the full length of the opening) that can have different mechanical characteristics than one another. There can also be provided more than one opening in the same or different transverse and vertical planes of the body (e.g., extending from each end or side) where each opening receives a different removable insert that can have the same or different mechanical characteristics. In such configurations, the adjustment provided by the removable inserts may not be uniform at the location of the opening(s) across the end or side. Such configurations may be advantageous for a mattress designed to accommodate more than one user (e.g., a queen or king size mattress), where each user is differently sized and/or has different preferences for support.

The adjustable mattress may include an outer cover that encloses some or all of the body of the mattress (e.g., that protects the mattress body, that is easy to clean, that has an aesthetically pleasing and/or brand-marked pattern) but includes one or more slits that permit access to one or more openings for receiving one or more removable inserts. These slits can be opened and closed by, for example, a zipper coupled to the slit, or any other mechanical fastening device such as button or hook-and-loop fasteners. A fire-retardant cover may be inserted beneath the outer cover that also encloses the entire body of the mattress. Such a fire-retardant cover can reduce deaths and injuries associated with mattress fires by limiting the size of the fire generated by a mattress or mattress set. Such a fire-retardant cover may not be required in every embodiment of the present apparatuses and methods (though it may be legally required in some jurisdictions, for example to comply with 16 C.F.R. § 1633.1). Similar to the outer cover, the fire-retardant cover can include one or more slits that permit access to the openings for receiving the removable inserts. The slits of the fire-retardant cover can be positioned in substantially the same locations as (e.g., substantially aligned with) the slits of the outer cover and also include, for example, a zipper coupled to the slits, so that a user can open the slits of the outer cover and the fire-retardant cover in sequence and without difficulty to access the openings. As an additional precaution (or as may be legally required in some jurisdictions, e.g., to comply with 16 C.F.R. § 1633.1), one or more fire shields can be included behind and/or in front of the slits of the fire-retardant cover. Such fire shields can extend entirely over the slits of the fire-retardant cover so that no portion of the mattress body is in direct contact with the slits of the fire-retardant cover and/or so that no portion of the outer cover (including the outer cover slits) is in direct contact with the slits of the fire-retardant cover. Such a shield may ensure that the body of the mattress is entirely enclosed and protected by fire-retardant materials. To provide access to the body of the mattress (and the openings) and/or the slits of the fire-retardant cover, the fire shield can be made from a flexible material and have one or more open ends not coupled to the fire-retardant cover such a user can simply move the fire shield out of the way (i.e., not entirely covering the slits) in the direction of the one or more open ends to provide access, and then simply move the fire shield back into slit-covering position when access is no longer needed.

A mattress, such as any of those described herein, can be manufactured by, first, forming multiple mattress layers, for example via foam molding. The mattress layers can be formed with one or more openings through the sides and/or ends of the mattress layers, for example through a specially designed mold. Alternatively or additionally, material can be removed from the sides and/or ends of the mattress layers after forming to create the one or more openings, for example by using heated wires or lasers. Alternatively or additionally, the mattress layers can be formed with one or more recesses in the top, bottom, and/or sides of the mattress layers and/or material removed from formed layers to create one or more recesses in the top, bottom, and/or sides of the mattress layers; and the mattress layers can be positioned so that the one or more recesses of adjacent layers align to together form openings. In some embodiments, material will not be removed from the top surface of the top layer or from the bottom surface of the bottom layer so that access to the to-be-formed openings is only possible through the sides and/or end of the mattress body.

After the multiple mattress layers have been formed and include one or more openings, the mattress layers are affixed together (in vertical and/or horizontal orientations), for example, by laminating or by friction, to form a mattress body. The mattress body can then, if desired, be fully or partially enclosed in an outer cover having one or more slits positioned over the location of the openings to provide access to the openings. A zipper or other means may be coupled to the outer cover to open and close the slits. Alternatively or additionally, the mattress body can be enclosed in a fire-retardant cover (before or after enclosing the mattress body in the outer cover, if included) and the fire-retardant cover can include one or more slits positioned over the location of the openings to provide access to the openings. If the fire-retardant cover is in addition to the outer cover, then the slits of the fire-retardant cover and the slits of the outer cover can be formed in the covers at substantially the same locations so that such slits align with one another over the location of the openings to provide ready access to the openings. Additionally, one or more fire shields may be coupled to the fire-retardant cover, if included, over the slits of the fire-retardant cover on the outside and/or inside of the fire-retardant cover, for example by laminating or sewing at least one end of the fire shields to the fire-retardant cover. The fire shields may be flexible and include at least one open end that may a user can move out of the way of the fire-retardant cover's slit to allow access past the fire shield to the openings of the mattress body.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments are described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale for at the least the embodiments shown.

DETAILED DESCRIPTION

Figure 1:
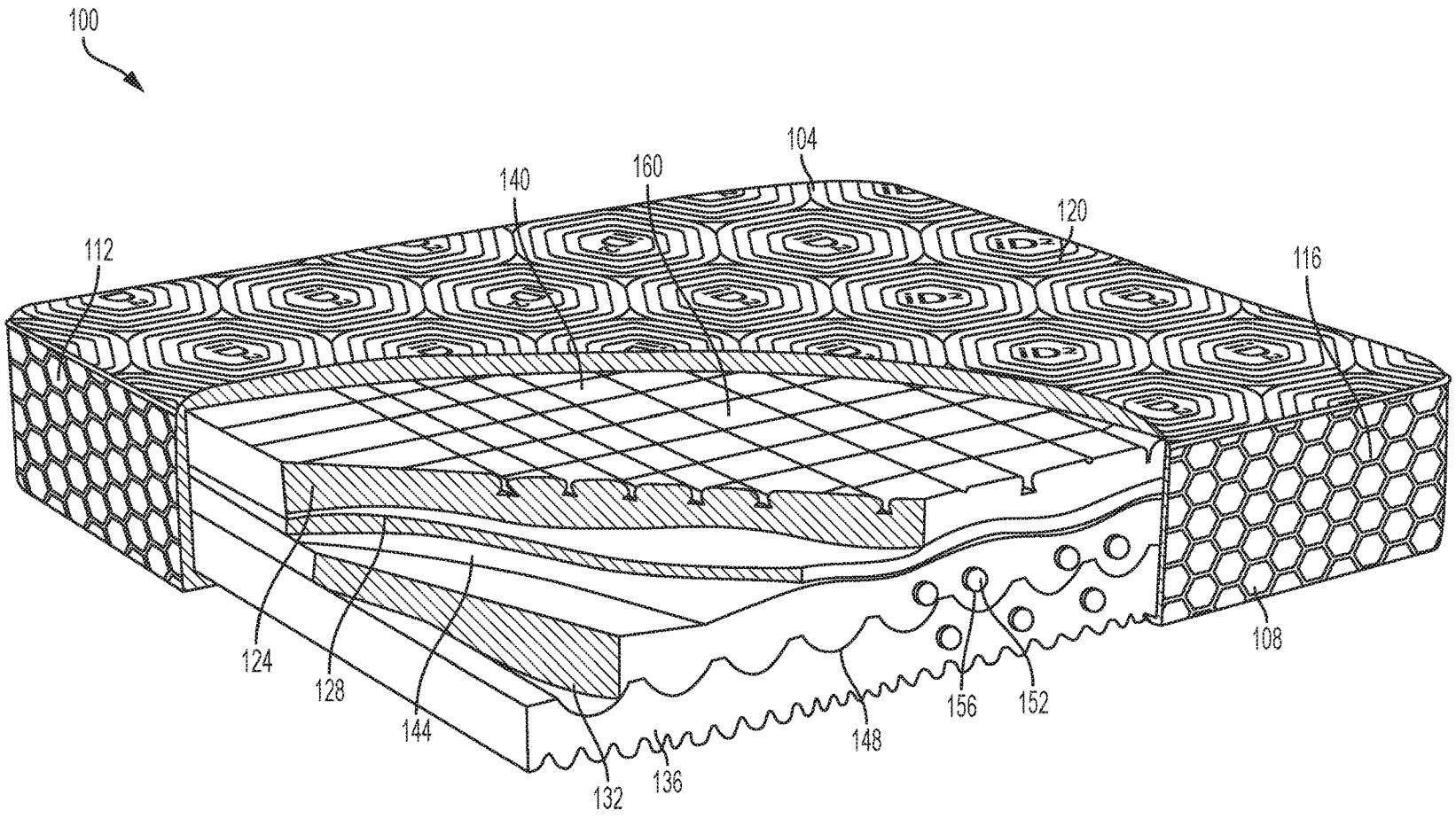
FIGS. 1, 2, and 3 depict isometric, partial cross-sectional views of mattresses according to embodiments of the disclosed apparatuses and methods.

Referring now to the drawings, and more particularly to FIG. 1, mattress 100 includes a top 104, bottom 108, two ends 112 (only one shown), and two sides 116 (only one shown). Ends 112 extend from top 104 to bottom 108 and to sides 116. Similarly, sides 116 extend from top 104 to bottom 108 and to ends 112. A cover 120 entirely encloses a body 160. Cover 120 can be made from upholstery or other materials, including materials designed to be seen by and be in contact with a user. For example, cover 120 can include an aesthetically pleasing image or pattern and/or a brand identifier and/or be made with stain-resistant and/or moisture-removing material. Portions of cover 120 (e.g., corresponding to top 104, bottom 108, ends 112, sides 116) can be made from different materials and/or have different characteristics. For example, the portions of cover 120 positioned at top 104 may be made from stain-resistant material while the portions of cover 120 positioned at bottom 108 may not. Body 160 is formed from a series of stacked foam layers (e.g., made from phase change memory foam, though the layers may be made from other or additional types of materials, such as gel and/or plastic), including top layer 124, support layer 128 beneath top layer 124, and foundation layers 132, 136 beneath support layer 128 in that order. Body 160 also includes a wicking interface 144 positioned between support layer 128 and foundation layer 132, as well as air flow channels 148 formed between foundation layers 132, 136. Wicking interface 144 can be made from cloth and/or other materials and can be substantially similar to the intermediate layer described in U.S. Pat. No. 7,520,012, which is incorporated by reference herein. Layers 124, 128, 132, 136 and interface 144 are shaped e.g., via cutting with a laser and/or using computer numerical control ("CNC")) to maintain contact with one another by friction (i.e., with mating surfaces that resist relative movement), but may also be affixed to one another with a laminate or by other means. Various features, such as the grooves at the bottom of foundation layer 136 or others described herein, may be formed into any of layers 124, 138, 132, 136 and interface 144 (e.g., via cutting with a laser, CNC, or other manufacturing methods), as desired.

Top layer 124 can be made from a relatively soft and non-rigid material, and can include ergonomic grooves/blocks 140 formed (e.g., via cutting with a laser and/or using CNC) into the top of top layer 124 that have channels for ventilating heat, for example from a user's body, and that can aid in providing pressure relief to, for example, a user's head, shoulders, hips, back, and/or knees. Support layer 128 can be more or less soft, rigid and/or dense than top layer 124 and can support a user's body past the top layer. Foundation layer 132 can be more rigid and/or dense than support layer 128 to provide more support to a user as well as provide structural integrity to the mattress. Foundation layer 136 can be as rigid and dense or more rigid and dense than foundation layer 132 to similarly provide support and structural integrity to body 160. The structural integrity of foundation layers 132, 136 also helps maintain the structure (e.g., the shape and position) of openings 156 (fourteen total, seven of which are in the side 116 that is not shown) positioned in foundation layers 132, 136, so a user may insert and remove inserts 152 within and from openings 156 multiple times without undue difficulty.

Openings 156 can extend though some or all of foundation layers 132, 136 between sides 116, as shown, and/or between ends 112. Openings 156 can include exposed ends for receiving removable inserts 152 on either side 116 (or end 112, depending on the configuration). An opening 156 can include an exposed interior surface (not shown) that mates with removable inserts 152 and runs the length of the opening 156. The exposed exterior surface can be configured to provide less resistance (e.g., friction) when inserting or removing a removable insert 152 by, for example, lining such exposed interior surface with low friction materials such as plastic or by melting plastic fibers, if any, in the foam, gel, and/or plastic of foundation layers 132, 136 immediately surrounding the opening 156. Openings in layers of a mattress can also be formed between mattress layers as shown and described with reference to FIGS. 2 and 2A or entirely within a support layer of a mattress as shown and described with reference to FIGS. 3 and 3A.

Figure 2:
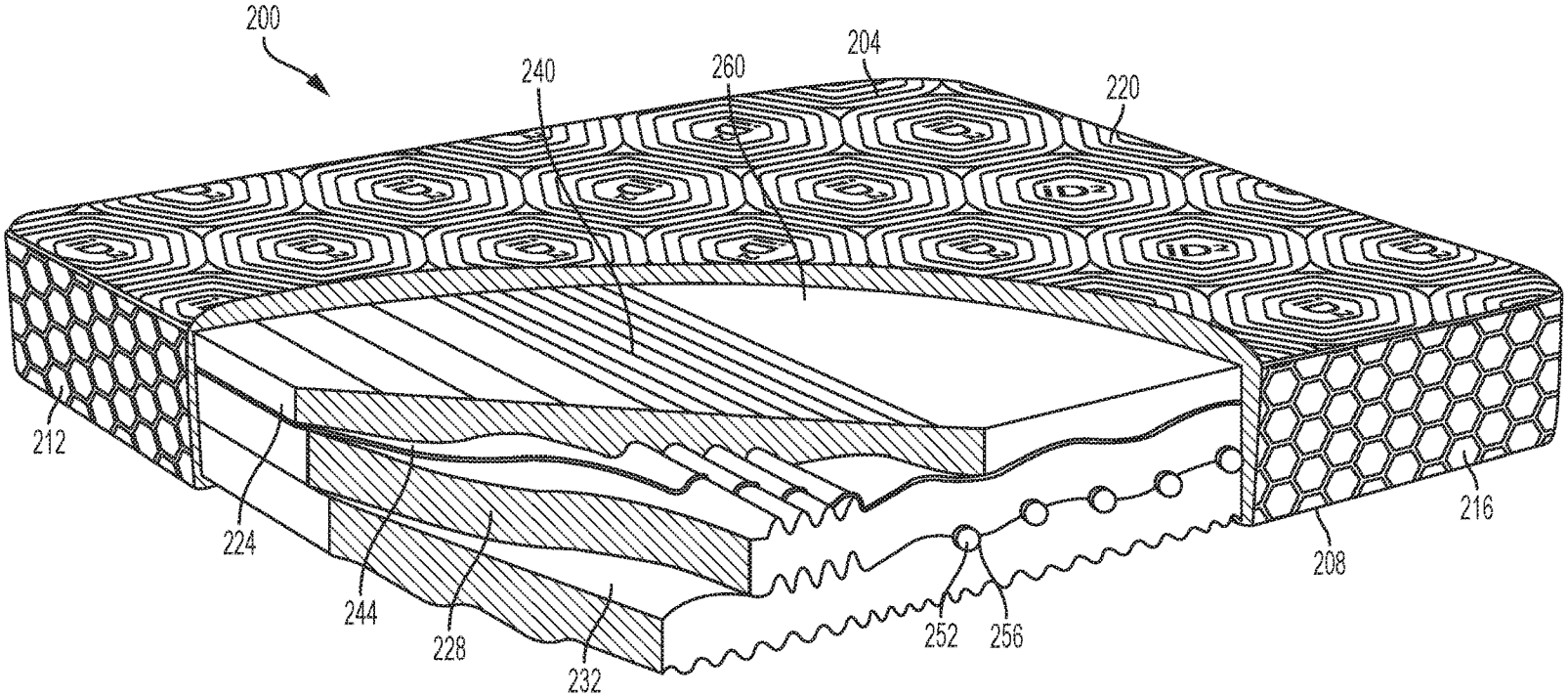
Figure 2A:
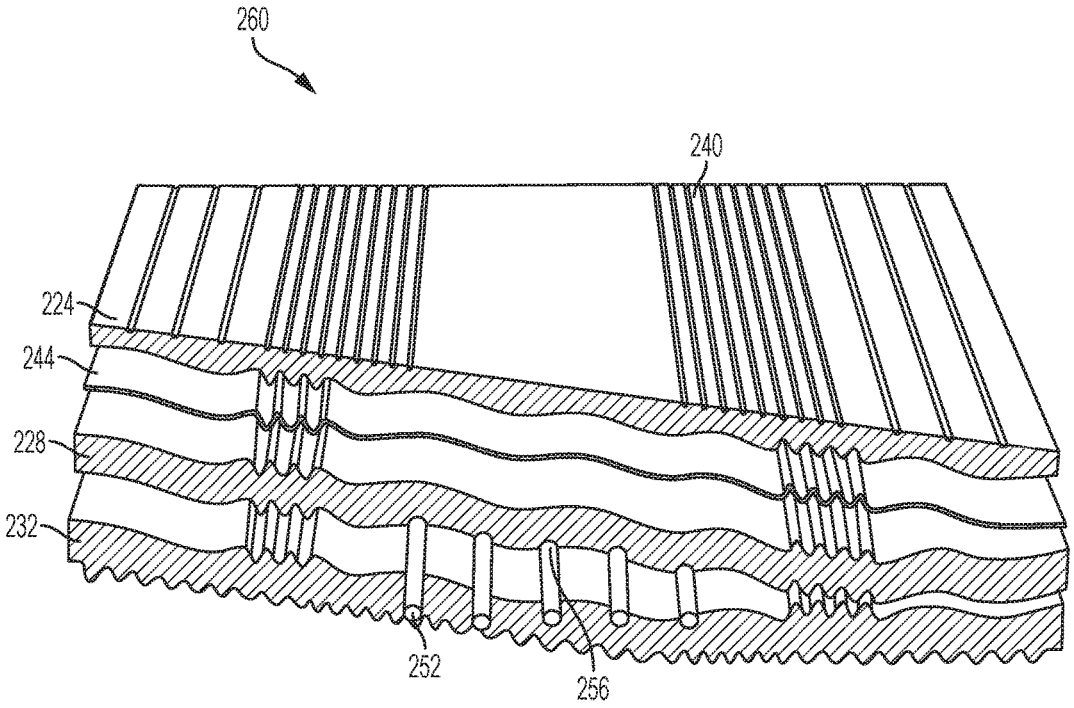

FIG. 2 shows an embodiment of a mattress 200 according to the disclosed apparatuses and methods that is similar to mattress 100, including a similar top 204, bottom 208, ends 212 (only one shown), sides 216 (only one shown), and cover 220. Mattress 200 also includes a mattress body 260 comprising a series of stacked foam layers (e.g., made from phase change memory foam, though the layers may be made from other or additional types of materials, such as gel and/or plastic) that are shaped to maintain contact with one another by friction (i.e., with mating surfaces that resist relative movement), but may also be affixed with laminate or by other means. Unlike mattress body 160, mattress body 260 includes only a single foundation layer 232 disposed below support layer 228, wicking interface 244, and top layer 224, in that order. These layers have substantially the same mechanical characteristics (e.g., strength, stiffness, rigidity, density) as foundation layer 132, support layer 128, and top layer 124, respectively, of mattress 100. Top layer 224 includes ergonomic grooves 240 formed (e.g., via cutting with a laser and/or using CNC) into the top of top layer 224 that can aid in providing pressure relief to a user's body.

Also unlike body 160, body 260 includes only ten openings 256 (five of which are in the side 216 that is not shown)

and the openings 256 are formed partially by recesses in the bottom surface of support layer 228 and partially by recesses in the top surface of foundation layer 232, as shown. Although different embodiments of the mattress may have more or less openings. Openings 256 are otherwise identical to openings 156 of FIGS. 1 and 1A. Removable inserts 252 may provide different amounts of support to a user when in direct contact with a support layer (e.g., support layer 228) rather than when disposed entirely within a foundation layer (e.g., foundation layers 132, 136).

Figure 3:
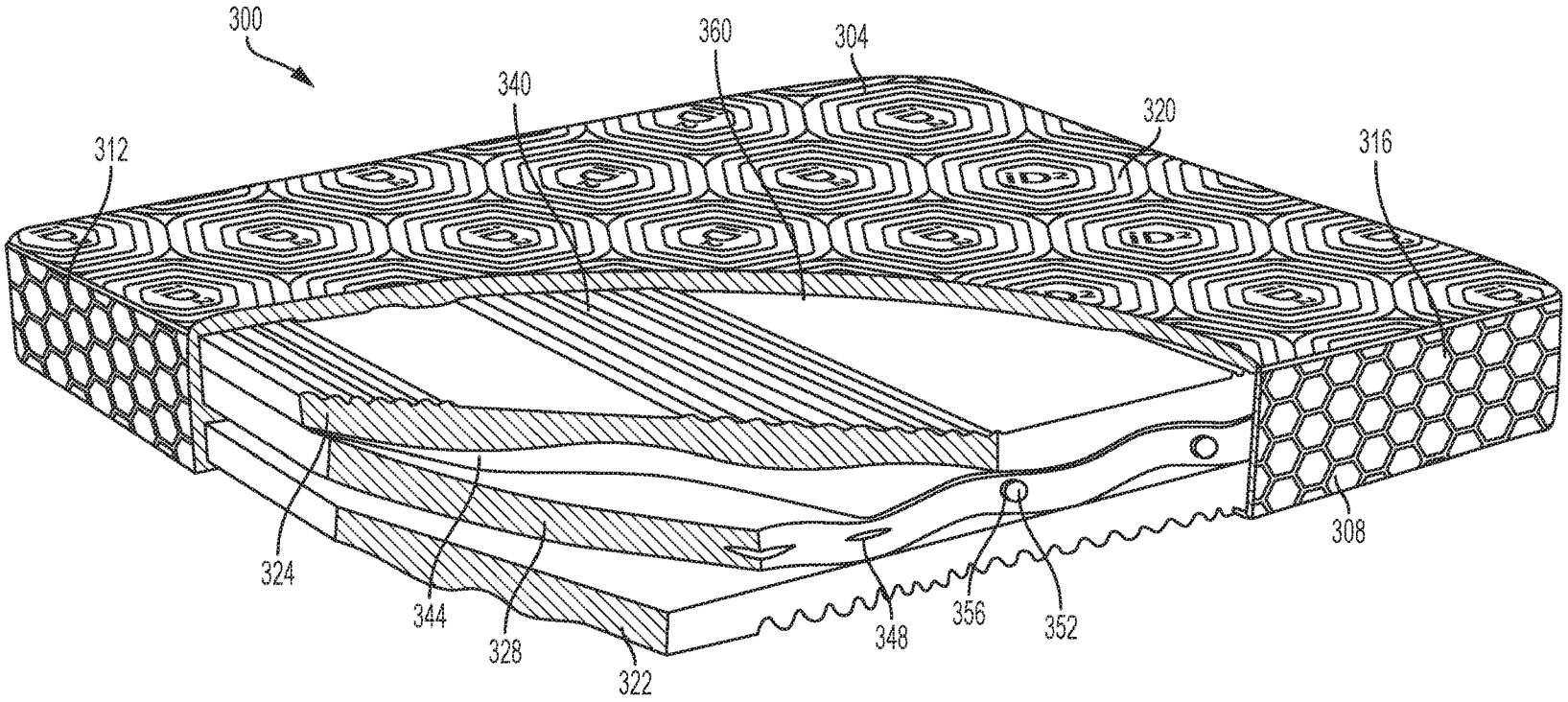
Figure 3A:
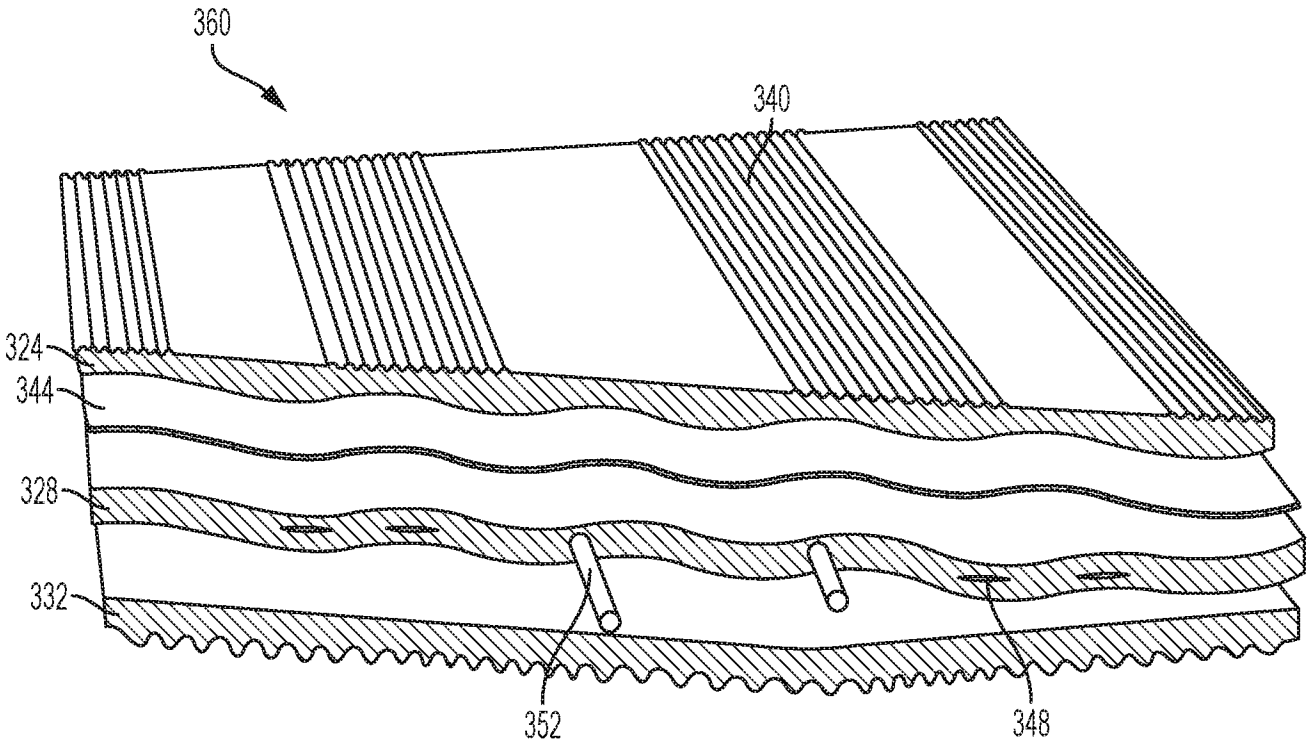

FIG. 3 shows an embodiment of a mattress 300 that is similar to mattress 100, including a similar top 304, bottom 308, ends 312 (only one shown), sides 316 (only one shown), and cover 320. Mattress 300 also includes a mattress body 360 comprising a series of stacked foam layers (e.g., made from phase change memory foam, though the layers may be made from other or additional types of materials, such as gel and/or plastic) that are shaped to maintain contact with one another by friction (i.e., with mating surfaces that resist relative movement), but may also be affixed with laminate or by other means. Unlike mattress body 160, mattress body 360 includes only a single foundation layer 332 disposed below support layer 328, wicking interface 344, and top layer 324, in that order. These layers have substantially the same mechanical characteristics (e.g., strength, stiffness, rigidity, density) as the foundation layer 132, support layer 128, and top layer 124, respectively, of mattress 100. Top layer 324 includes ergonomic grooves 340 formed (e.g., via cutting with a laser and/or using CNC) into the top of top layer 324 that can aid in providing pressure relief to a user's body.

Also unlike body 160, body 360 includes only four openings 356 (two of which are in the side 316 that is not shown) and the openings 356 are formed entirely within support layer 328, as shown, although any number of openings is possible. Openings 356 are otherwise identical to openings 156 of FIGS. 1 and 1A. Removable inserts 352 may provide different amounts of support to a user when in a support layer (e.g., support layer 328) rather than in a foundation layer (e.g., foundation layers 132, 136). Support layer 328 also includes air flow channels 348.

Figure 4A:
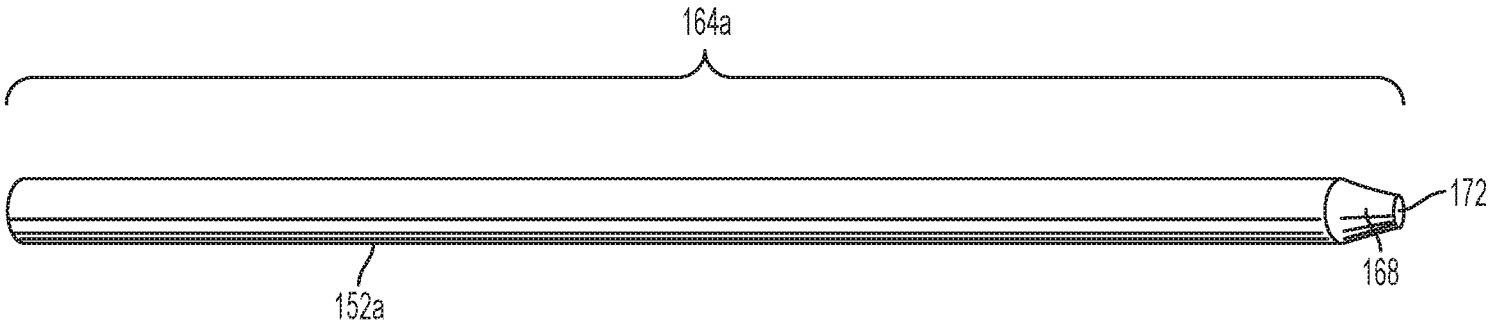
FIGS. 4A and 4B depict removable inserts according some embodiments of the disclosed apparatuses and methods.
Figure 4B:
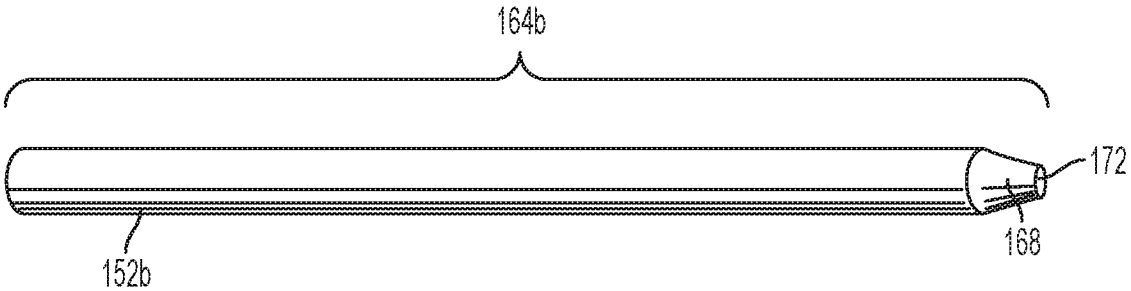

Referring now to FIGS. 4A and 4B, removable inserts 152*a*, 152*b* (also referred to as wands or rods) may be similar to removable inserts 252 and 352 of FIGS. 2, 2A, 3 and 3A. Removable inserts 152*a*, 152*b* can be made from a variety of materials, such as plastic, plastic-encased foam, polyethylene, or other materials, and can have mechanical characteristics (e.g., strength, stiffness, density, rigidity) similar to or different from the material of the mattress layer or layers forming the openings in which removable inserts 152*a*, 152*b* are received (e.g., foundation layers 132, 136). For example, if no additional support is desired by a user at a particular opening location, then removable inserts 152*a*, 152*b* can have the same mechanical characteristics as the material of the layers or layers forming such opening. If additional support is desired, then removable inserts 152*a*, 152*b* can have, for example, greater rigidity than the material of the layers or layers forming such opening. Removable inserts 152*a*, 152*b* include a sloping tip 168 having a blunted end 172 to help guide removable inserts 152*a*, 152*b* into the openings of a mattress body (e.g., openings 156) without damaging the material forming the openings. Removable inserts 152*a*, 152*b* may have different lengths 164*a*, 164*b*, respectively. In one embodiment, a twin-size mattress may only be able to receive a single removable insert 152*b* in each of its openings, for example, where the openings are short and/or lie in a common transverse and vertical plane of the mattress (i.e., at same location on opposite sides or ends of the mattress body). In such a mattress, a removable insert 152*a* may be too long and could protrude substantially past the end of such openings. However, a king size mattress of the present disclosure may fit a removable insert 152*a* to substantially fill its openings. Alternatively or additionally, a single removable insert may be used to fill an opening that runs the entire length or width of a mattress. For example, removable insert 152*b* may substantially fill and not extend beyond or substantially beyond the ends of an opening that runs the entire length or width of a twin-size mattress of the present disclosure; or removable insert 152*a* may substantially fill and not extend beyond or substantially beyond the ends of an opening that runs the entire length or width of a king size mattress of the present disclosure. In some embodiments, two or more removable inserts of same or different sizes may be inserted into an opening to provide a mattress feel that varies across the mattress. For example, rods of one characteristic may be inserted in openings on a first side of the mattress and rods of a different characteristic may be inserted in openings on a second side of the mattress. Using multiple rods in the openings may provide a sleeper on a left-side of the mattress a different feel than a sleeper on a right-side of the mattress. It will be appreciated that removable inserts 152*a*, 152*b* are merely representative and that similar inserts of any size or shape (including length and diameter) may be configured for use with various mattress types, sizes, and/or shapes.

Figure 5:
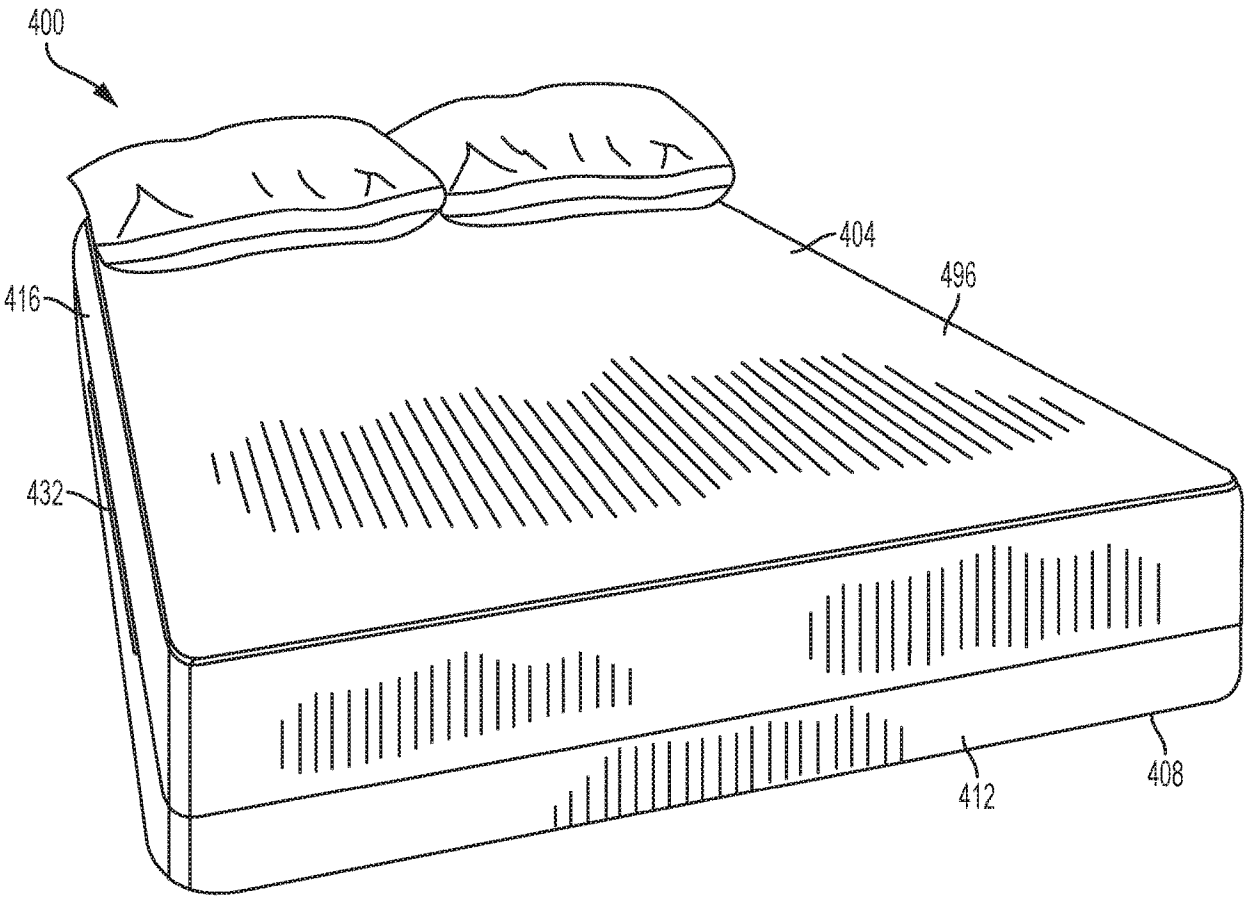
FIG. 5 depicts a user-accessible mattress according to an embodiment of the disclosed apparatuses and methods.

For a user to position or remove inserts 152*a*, 152*b* (or similar removable inserts) in openings of a mattress body of the present disclosure, the outer cover of such mattress, if present, must permit access to the openings. FIG. 5 illustrates mattress 400 having a top 404, bottom 408, ends 412 (only one shown), and sides 416 (only one shown). Mattress 400 may also include an outer cover 496 having slits 432 (only one shown) on side 416. Mattress 400 can be one of the mattresses 100, 200, and 300 previously discussed and outer cover 496 can entirely or partially enclose the body of mattress 400. Although positioned on the sides 416 of mattress 400, it will be appreciated that slits 432 (or additional or alternative slits) may be alternatively or additionally be positioned on ends 412 of mattress 400.

Figure 6:
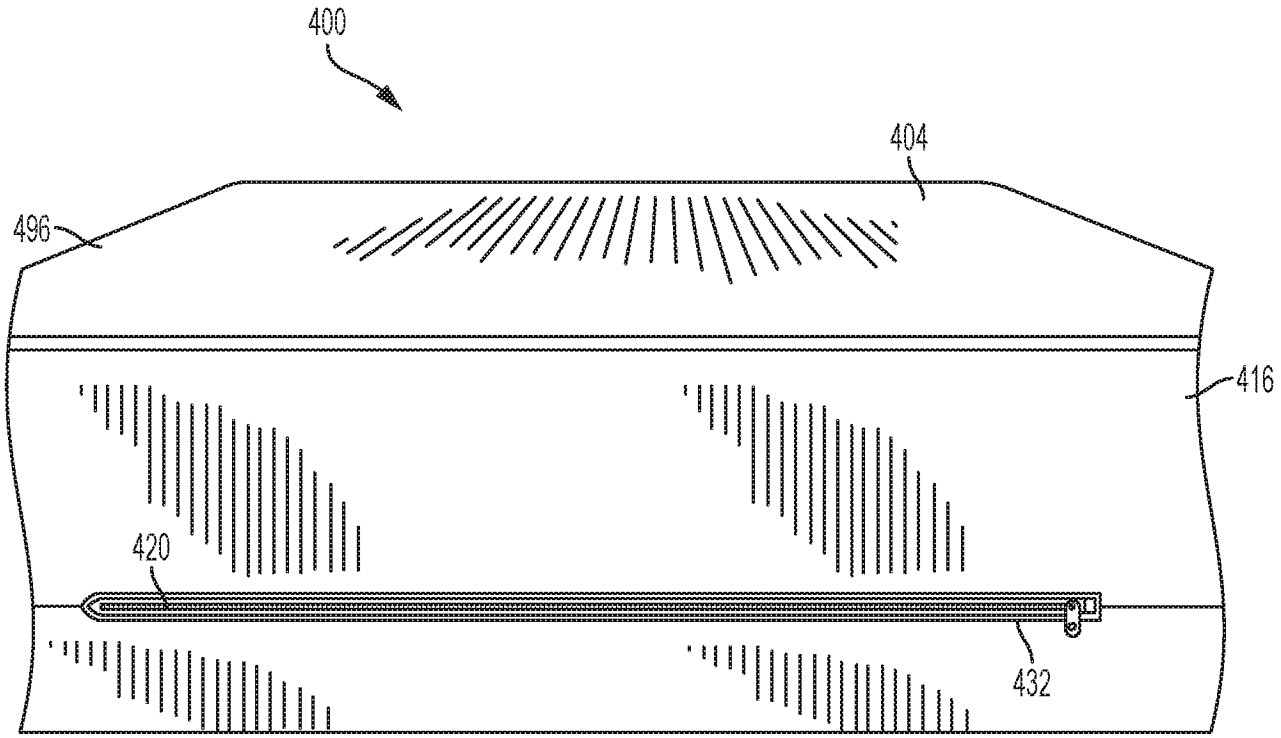
FIG. 6 depicts a partial side view of the mattress of FIG. 5.
Figure 7:
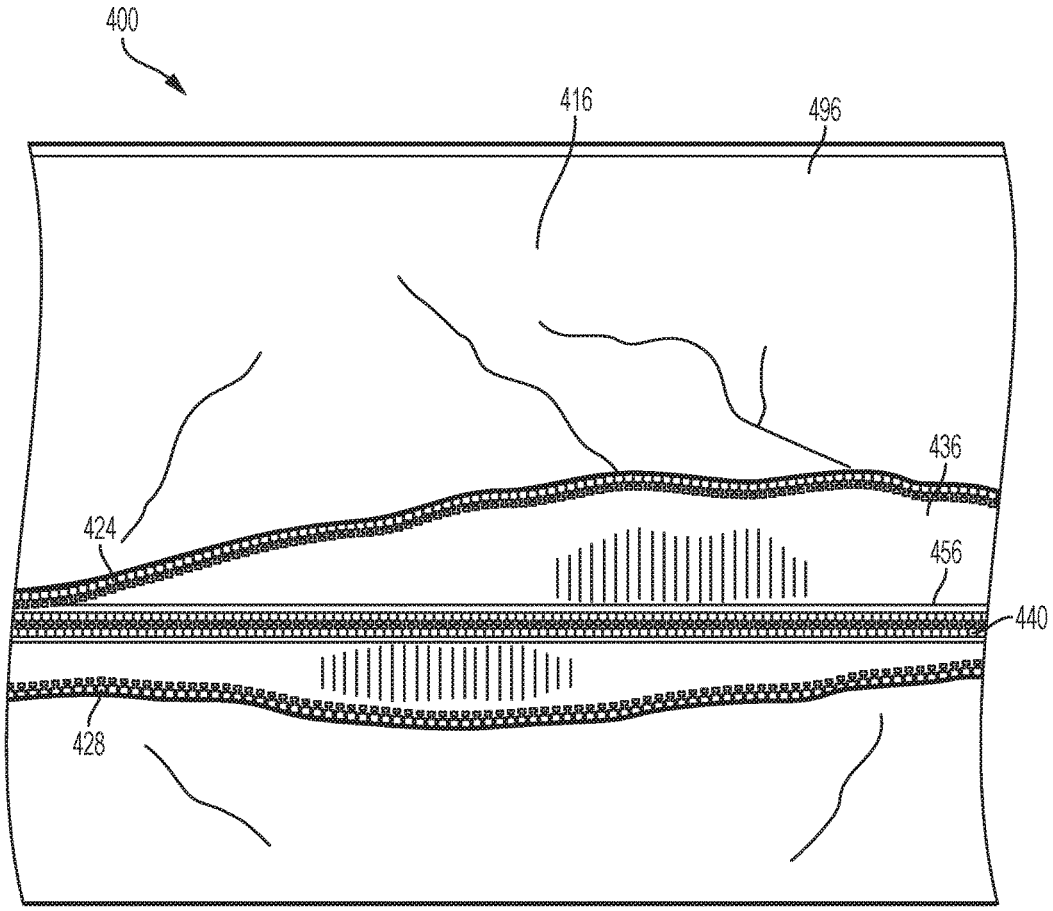
FIG. 7 depicts a partial side view of the mattress of FIG. 5 in a partially open configuration according to an embodiment of the disclosed apparatuses and methods.

FIG. 6 depicts a partial side view of mattress 400 showing a slit 432 of outer cover 496 in a side 416 of mattress 400. Slit 432 includes a zipper 420 to allow a user to open and close slit 432 as desired, though other means (e.g., buttons, hook-and-loop fasteners) may be employed in addition to or in place of zipper 420. FIG. 7 depicts another partial side view of mattress 400 with zipper top 424 and zipper bottom 428 of zipper 420 separated such that a user can access another slit 456 of an inner fire-retardant cover 436. Fire-retardant cover 436 can entirely encompass mattress 400 to reduce deaths and injuries associated with mattress fires by limiting the size of the fire generated by a mattress or mattress set. Fire-retardant cover 436 may not be required in every embodiment of the present apparatuses and methods (though it may be legally required in some jurisdictions, for example to comply with 16 C.F.R. § 1633.1), such that slit 432 in cover 496 could permit direct access to the body of mattress 400, including to the openings formed therein. Fire-retardant cover 436 includes a zipper 440 to allow a user to open and close slit 456 as desired, though other means (e.g., buttons, hook-and-loop fasteners) may be employed in addition to or in place of zipper 440.

Conventionally, users are not allowed access through a fire-retardant barrier cover. This conventional practice is intended to increase the likelihood of the fire-resistance cover operating as intended, and thus passing certain jurisdictional safety laws. Allowing the user an ability to remove the fire-retardant cover could lead to unintended harm to the user based on their inability to re-apply the covering in an effective manner. Even when a user intended to reinstall the cover correctly, errors could be made that affect the fire-resistance capability. Furthermore, removing the fire-retardant cover on a large-size mattress may be difficult without more than one person or for small-sized users. The slits in the fire-retardant cover and a second cover over the fire-retardant cover allow a user to quickly access the openings to adjust the mattress while limiting the likelihood of compromising the fire-retardant aspect of the cover. With the slits and zippers in the cover, the user does not need to remove the entire cover. Instead, a user is provided access only to the portion of the body of the mattress that can be user adjusted. Furthermore, that access is provided in a manner that is easy to close and return the mattress to its factory-original safety rating.

Figure 8A:
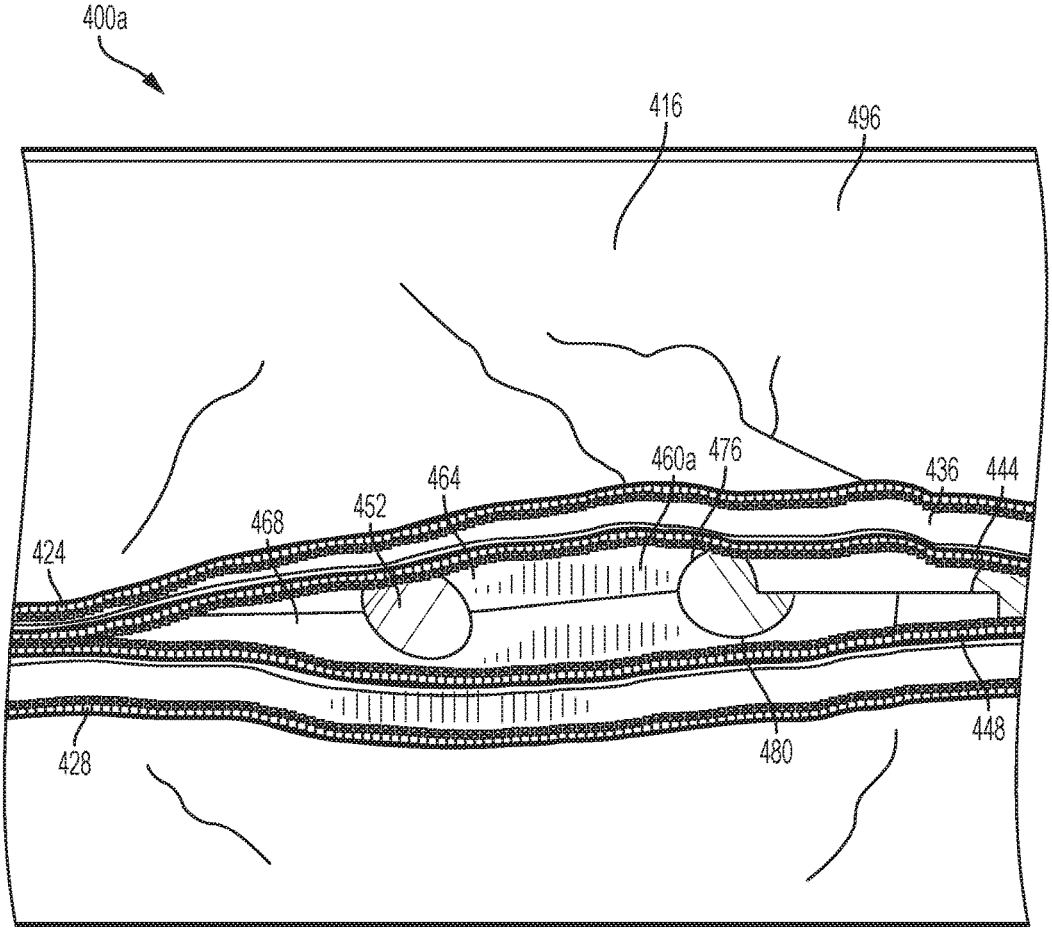
FIGS. 8A-8C depict partial side views of the mattress of FIG. 5 in an open configuration according to some embodiments of the disclosed apparatuses and methods.
Figure 8B:
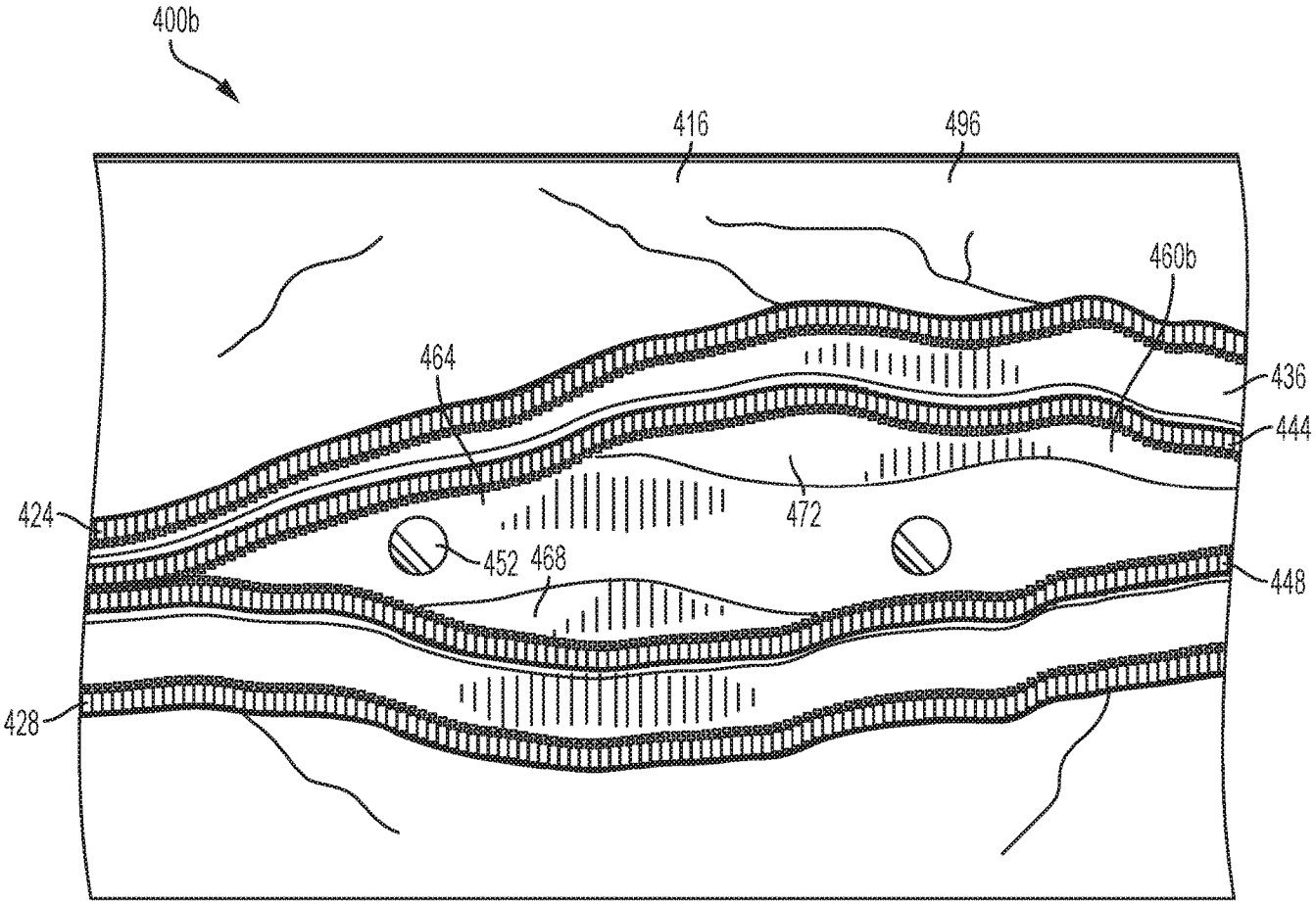
Figure 8C:
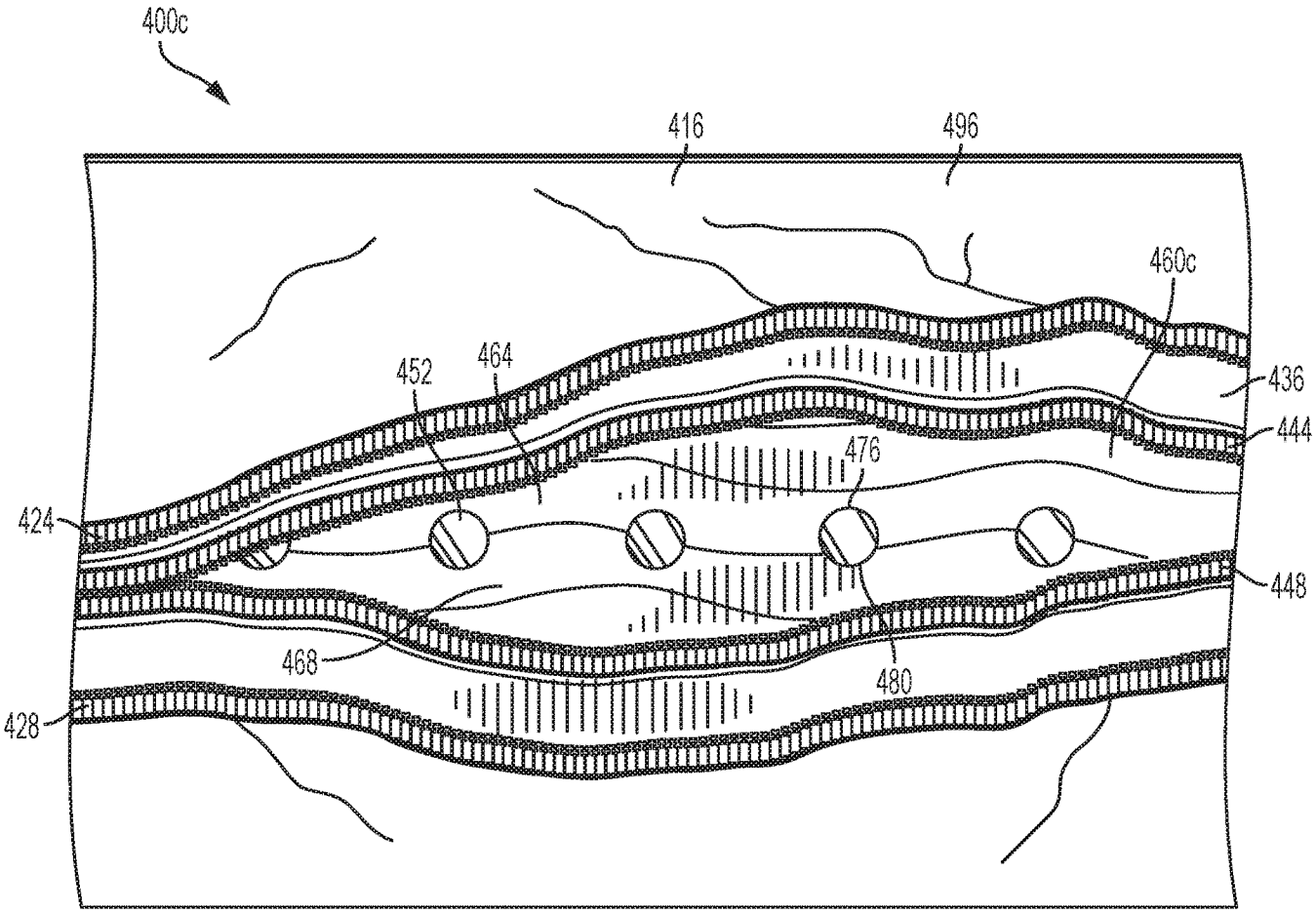
Figure 13:
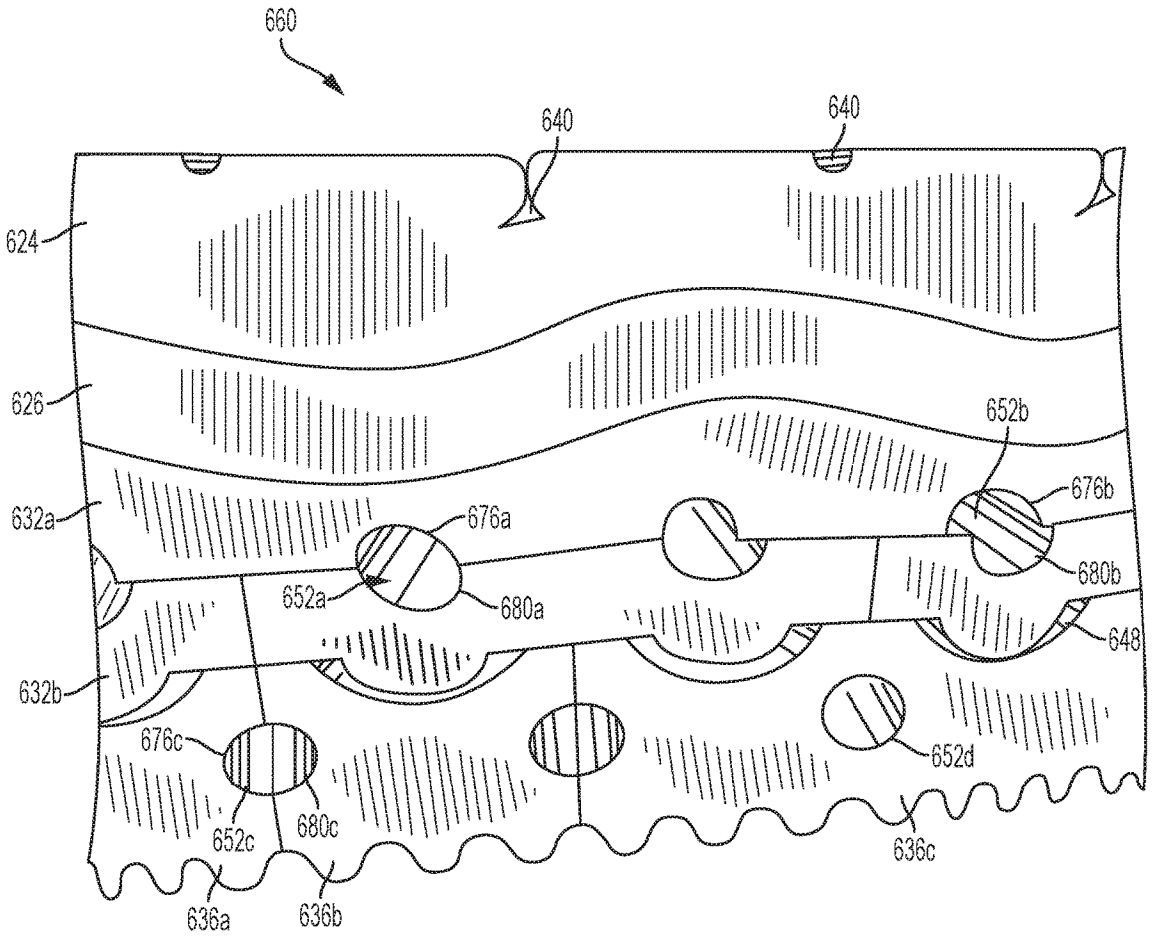
FIG. 13 depicts a partial side view of a mattress formed according to embodiments of the disclosed methods.

FIGS. 8A-8C depict partial side views of embodiments 400*a*-400*c*, respectively, of mattress 400 with zipper top 444 and zipper bottom 448 of zipper 440 (as well as zipper top 424 and zipper bottom 428 of zipper 420 of outer cover 496) separated such that a user can access mattress bodies 460*a*-460*c*, respectively. Mattress body 460*a* (shown in FIG. 8A) includes openings 452 formed by aligning recesses 476, 480 of two adjacent mattress body layers 464, 468, respectively. Some of the openings 452 are not substantially aligned. An embodiment of such a mattress body is shown and described generally with reference to mattress body 660 of FIG. 13. As shown in FIG. 13, such a mattress body may also include additional openings in or between adjacent mattress layers.

Figure 1A:
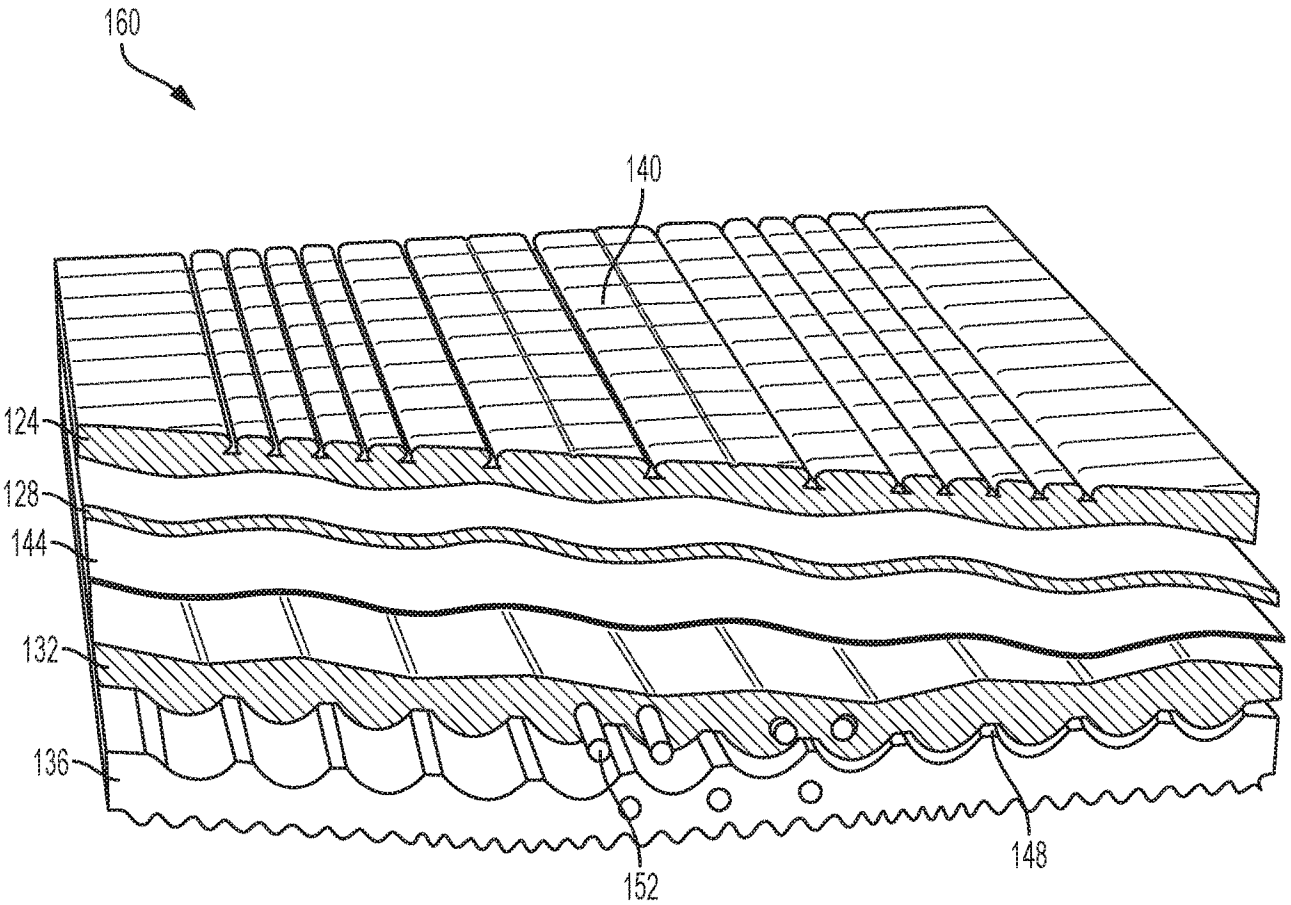
FIGS. 1A, 2A, and 3A depict partially exploded isometric views of the mattresses of FIGS. 1-3, respectively (without a mattress cover, for clarity), according to embodiments of the disclosed apparatuses and methods.

Mattress body 460*b* (shown in FIG. 8B) includes openings 452 formed directly within body layer 464 between body layers 468 and 472. Embodiments of such a mattress body are shown and described with reference to mattress body 160 of FIGS. 1 and 1A and mattress body 360 of FIGS. 3 and 3A. As shown in FIGS. 1 and 1A, such a mattress body may also include additional openings in adjacent mattress layers. Such a mattress body may also include openings between adjacent layers.

Mattress body 460*c* (shown in FIG. 8C) depicts openings 452 formed by aligning recesses 476, 480 of adjacent mattress body layers 464, 468, respectively. Openings 452 are substantially aligned. An embodiment of such a mattress body is shown as mattress body 260 of FIGS. 2 and 2A. While not shown in FIGS. 2 and 2A, such a mattress body may also include additional openings in or between adjacent mattress layers.

Figure 9:
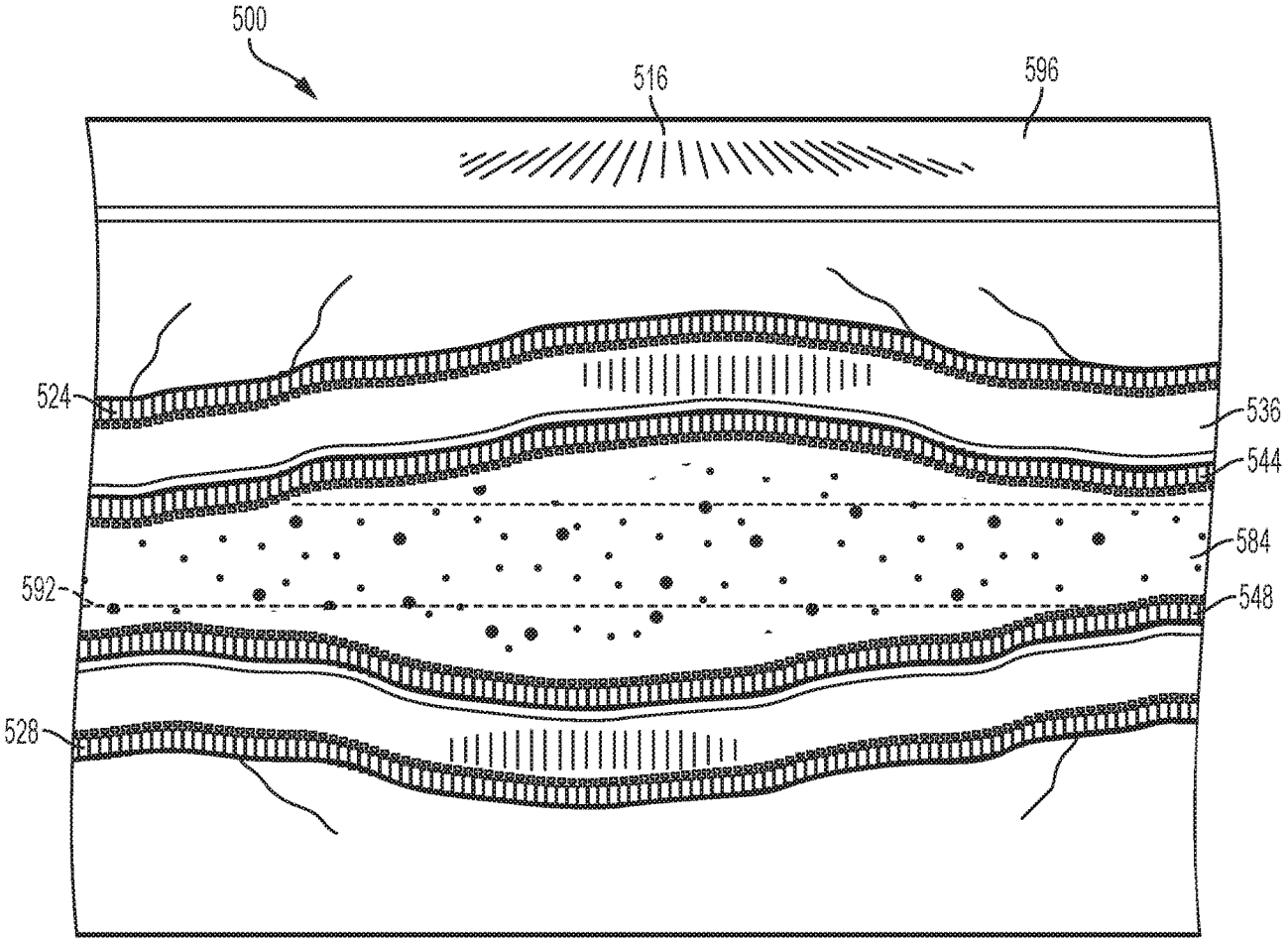
FIGS. 9 and 10 depict a partial side view of a mattress in a partially open configuration according to some embodiments of the disclosed apparatuses and methods.
Figure 10:
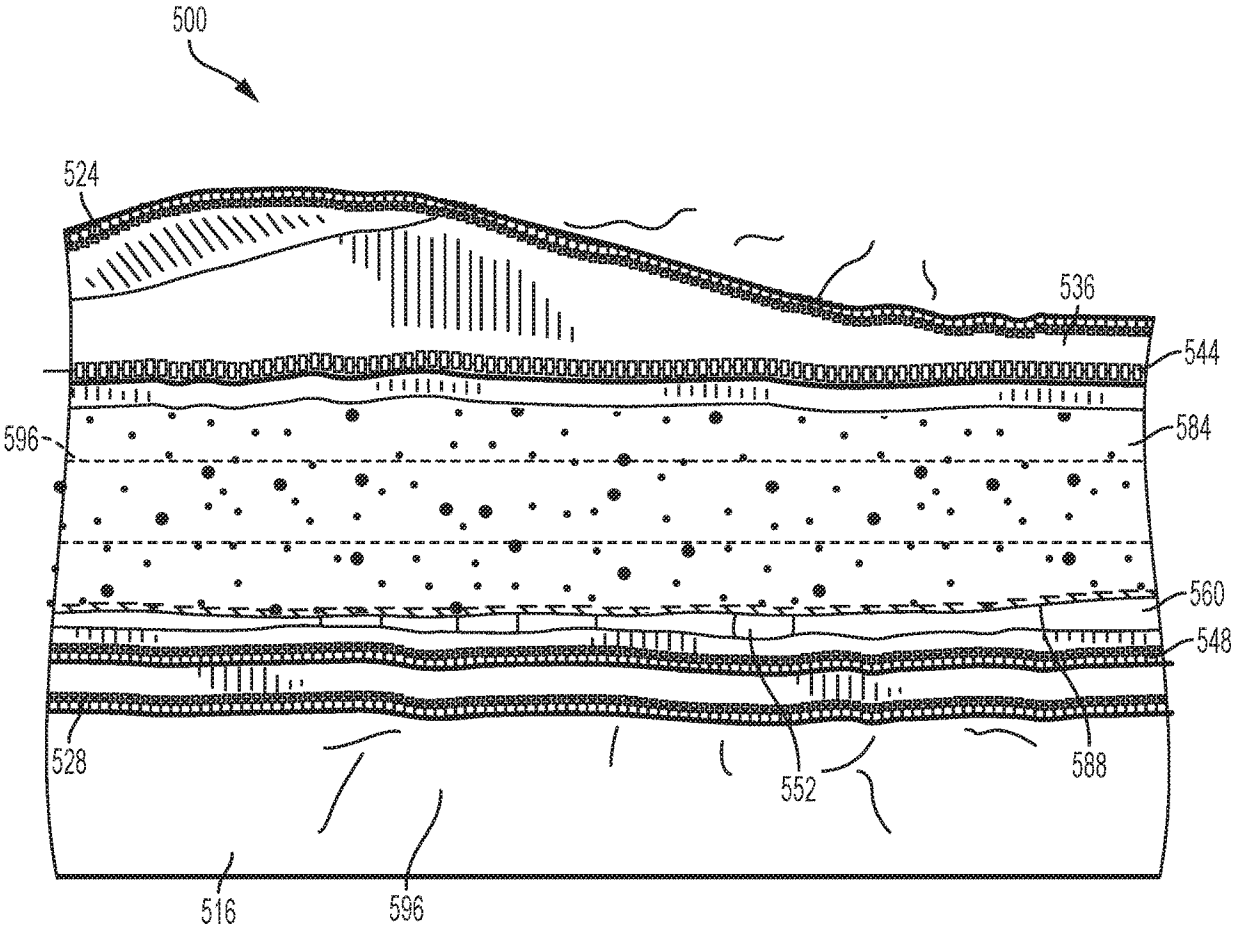
Figure 11:
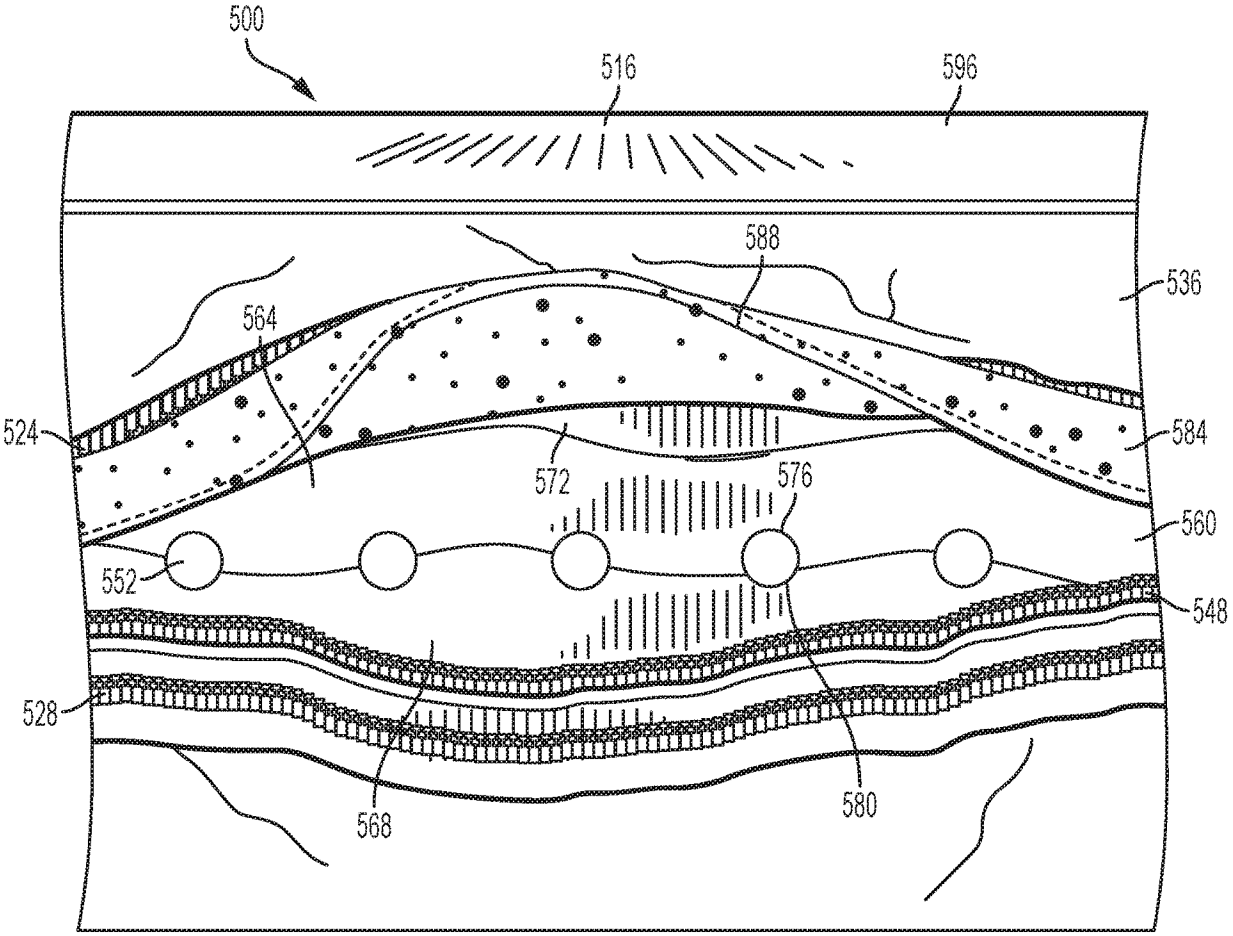
FIG. 11 depicts a partial side view of the mattress of FIGS. 9 and 10 in an open configuration according to an embodiment of the disclosed apparatuses and methods.

FIGS. 9-11 depict partial side views of embodiments of a mattress 500 that is similar to mattress 400 but includes one or more fire shields 584 positioned behind and coupled to a fire-retardant cover 536. Horizontal dotted lines 592 are shown for location reference. Like mattress 400, mattress 500 includes a zipper top 524 and zipper bottom 528 that can be used in conjunction to open or close a slit formed in an outer cover 596 positioned on a side 516 of mattress 500 (though other means such as buttons or hook-and-loop fasteners may additionally or alternatively be used). A similar system (e.g., slit with zipper) may be employed on another side or end (e.g., opposite side 516 that is not shown) of mattress 500. Although positioned on the sides 516 of mattress 500, it will be appreciated that the slits of mattress 500 (or additional or alternative slits) may be alternatively or additionally be positioned on the ends (not shown) of mattress 500. Outer cover 596 can partially or entirely enclose a body of mattress 500 when zipper top 524 and zipper bottom 528 are in a closed configuration. FIGS. 9-11 show zipper top 524 and zipper bottom 528 in an open configuration.

Also like mattress 400, mattress 500 includes an inner fire-retardant cover 536 that can entirely encompass mattress 500 to reduce deaths and injuries associated with mattress fires by limiting the size of the fire generated by a mattress or mattress set. Fire-retardant cover 536 may not be required in every embodiment of the present apparatuses and methods (though it may be legally required in some jurisdictions, for example to comply with 16 C.F.R. § 1633.1). Fire-retardant cover 536 includes a zipper top 544 and zipper bottom 548 that can be used in conjunction to open and close a slit formed in fire-retardant cover 536 (though other means such as buttons or hook-and-loop fasteners may additionally or alternatively be used). The slit in fire-retardant cover 536 is conveniently located directly behind the slit of outer cover 596, so that a user can quickly and easily access both in sequence, although other alignments of the cover and slit may allow access. A similar system (e.g., slit with zipper) may be employed in fire-retardant cover on another side or end (e.g., opposite side 516 that is not shown) of mattress 500. Positioned behind and entirely covering the shown slit of fire-retardant cover 536 is a fire shield 584. Fire shield 584 can be made of similar or different materials than fire-retardant cover 536, and can accomplish a similar purpose of reducing deaths and injuries associated with mattress fires by limiting the size of the fire generated by a mattress or mattress set. Mattress shield 584 may be legally required in some jurisdictions, for example, to comply with 16 C.F.R. § 1633.1. Mattress shield 584 is positioned directly behind the shown slit of fire-retardant cover 536 to help ensure that no portion of the body of mattress 500 is exposed to the shown slit of fire-retardant cover 536 because such slit may inadvertently be left open by a user or may not provide on its own sufficient fire-resistance. Although depicted behind the shown slit of fire-retardant cover 536, a fire shield 584 may also or additionally be positioned in front of the shown slit of fire-resistance cover 536.

As shown in FIG. 10, fire shield 584 is not coupled at its lower end 588 to fire-resistance cover 536 such that a user may further open the shown slit of fire-retardant cover 536 (and the shown slit of outer cover 596) to expose a portion of mattress body 560, including openings 552 positioned therein. As shown in FIG. 11, fire shield 584 may be flexible such that a user can move a portion of fire shield 584 (e.g., from lower end 588) to gain full access to openings 552 of mattress body 560. Mattress body 560 depicts openings 552 formed by aligning recesses 576, 580 of adjacent mattress body layers 564, 568, respectively. An embodiment of such a mattress body is shown as mattress body 260 of FIGS. 2 and 2A. While not shown in FIGS. 2 and 2A, such a mattress body may also include additional openings in or between adjacent mattress layers.

Figure 12A:
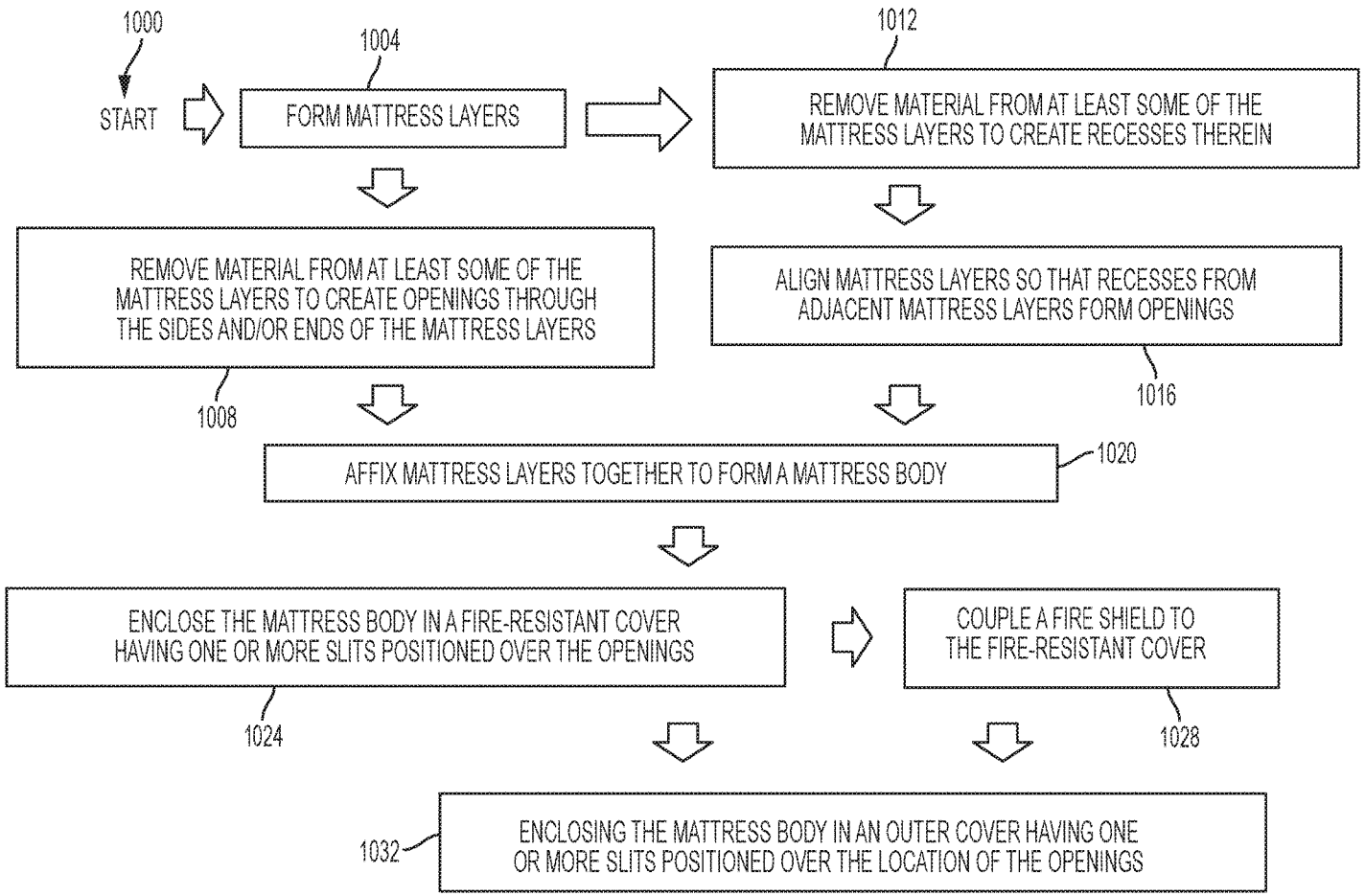
FIGS. 12A and 12B depict flow charts of methods of forming mattresses according to embodiments of the disclosed apparatuses and methods.

The mattresses of the present disclosure, including mattresses 100, 200, 300, 400, and 500 can be created by one or more of the methods disclosed and described with reference to FIGS. 12A and 12B. A method 1000 of forming a mattress may include, at step 1004, forming one or more mattress layers. Such layers can be formed using any known or later-developed method of manufacturing, such as forming or molding, including injection molding and foam molding. At step 1008, material, such as foam, gel, and/or plastic, is removed from at least some of the mattress layers to create openings through the sides and/or ends of the mattress layers. Such openings are used to receive one or more removable inserts as described herein. Step 1008 may not include forming such openings by removing material from the top surface of the top layer or the bottom surface of the bottom layer. Accordingly, access to the openings may be only through the ends or sides of the mattress layers. Step 1008 may form openings that are entirely contained in one layer of the mattress. Steps 1012 and 1016 may form openings that span multiple layers of the mattress. Alternatively or additionally, at step 1012, material, such as foam, gel, and/or plastic, is removed from at least some of the mattress layers to form one or more recesses in the layers. At step 1016, layers having such recesses are aligned on top of or next to one another (depending on the configuration) to together form openings between the adjacent layers. Such openings are used to receive one or more removable inserts as described herein. Steps 1012 and 1016 may not include forming such recesses to create such openings by removing material from the top surface of the top layer or from the bottom surfaces of the bottom layer. Accordingly, access to the openings may be only through the ends or sides of the mattress layers.

At step 1020, the mattress layers are affixed together to form a mattress body. Such mattress layers can be affixed on top of each other and/or next to each other by friction (i.e., with mating surfaces of the layers that resist relative movement), by laminating, and/or by other means. A mattress body may be created by performing step 1020 before step 1008 or step 1012, such that the mattress layers are affixed together and then material removed. In such a method, step 1016 can occur as part of step 1020. In method 1000, the exposed (i.e. inner) surface of the openings, regardless of how the openings are formed, can be made to provide less resistance (e.g., friction) when inserting or removing a removable insert by, for example, lining such exposed interior surface with low friction materials, such as plastic, or by melting plastic fibers, if any, in the foam, gel, and/or plastic immediately surrounding the opening. Such smoothing can be performed before or after performing step 1020.

Once a mattress body has been formed having the desired openings via some or all of steps 1004, 1008, 1012, 1016, and 1020, the mattress body may be enclosed in a fire-retardant cover in step 1024. The fire-retardant cover will include at least one slit configured to be positioned over at least some of the openings of the mattress body, for example, as shown and described with reference to FIGS. 5-8C. Additionally, at step 1028, the fire-retardant cover may be coupled to one or more fire shields, such that each fire shield is positioned entirely over at least one slit of the fire-retardant cover. Such a configuration is shown and described, for example, with reference to FIGS. 9-11. At step 1032, the mattress body (within a fire-retardant cover and with a fire-retardant shield, depending on performance of steps 1024 and 1028) is enclosed by an outer cover having one or more slits positioned over the location of at least some of the openings. Such an outer cover can be, for example, an outer cover 120, 220, 320, 496, or 596, as described herein with reference to FIGS. 1-11. It will also be appreciated that step 1032 can be performed without performing one or both of steps 1024 and 1028, though performing one or both of steps 1024 may be legally required in some jurisdictions, for example, to comply with 16 C.F.R. § 1633.1.

Figure 12B:
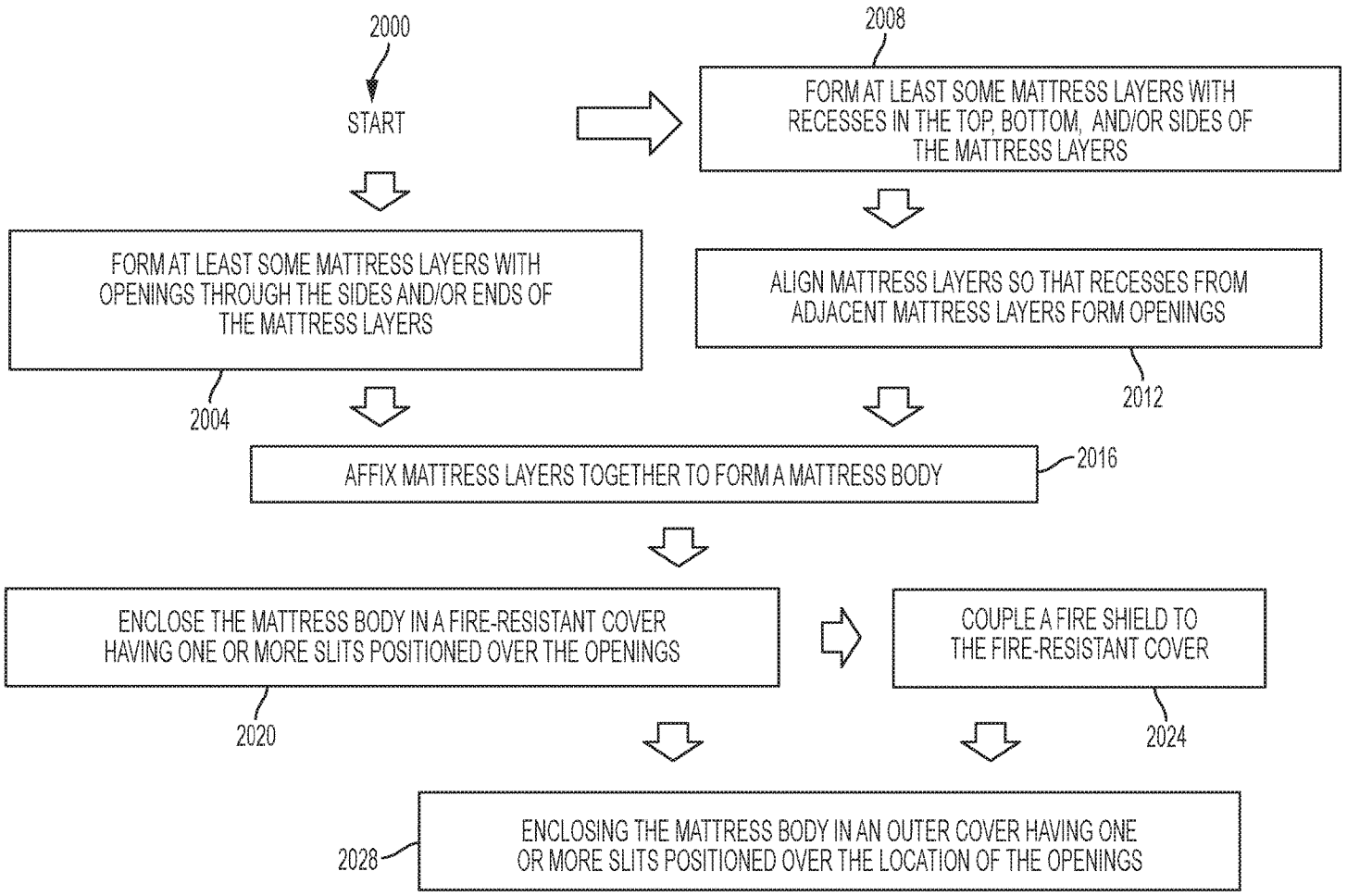

Method 2000 shown and described with reference to FIG. 12B is similar to method 1000 of FIG. 12A, but does not include the steps of removing material from one or more mattress layers to create recesses and/or openings in the sides and/or ends thereof. Instead, method 2000 begins by directly forming either openings (step 2004) or recesses (step 2008) in the sides and/or ends of at least some of the mattress layers when the mattress layers are themselves formed. This can be performed, for example, by using a mattress layer mold designed to create such openings and/or recesses. If recesses are formed in step 2008, then at step 2012, such recesses are aligned when the mattress layers are put together such that the recesses of adjacent layer together form one or more openings for receiving one or more removable inserts, similar to step 1012 of method 1000. Steps 2016, 2020, 2024, and 2028 are similar to steps 1016, 1020, 1024, and 1028, including the having the options described in method 1000, such as performing only some of the steps and/or performing the steps in different orders.

The mattress body 660 shown in FIG. 13 can be formed using either of methods 1000 or 2000 or another method. Mattress body 660 includes multiple layers, including top layer 624, support layer 626, foundation layer 632 (formed of foundation layers 632*a* and 632*b*), and foundation layer 636 (formed of foundation layers 636*a*, 636*b*, and 636*c*). Such layers have substantially similar mechanical characteristics (e.g., strength, stiffness, rigidity, density, thermal resistance) as the respective top, support, and foundation layer(s) of mattress bodies 160, 260, and 360 of FIGS. 1-3A, and can also have other similar features. For example, top layer 624 can include grooves/blocks 640 formed (e.g., via cutting with a laser and/or using CNC) into the top of top layer 624 that have channels for ventilating heat, for example from a user's body, and that can aid in providing pressure relief to, for example, a user's head, shoulders, hips, back, and/or knees. As another example, air flow channels 648 can be positioned between the bottoms of sections of foundation layers 632*a* and the tops of foundation layers 636*a*, 636*b*, and 636*c*.

Four different openings 652*a*-652*d* within mattress body 660 are shown in FIG. 13. Opening 652*a* is formed by aligning mattress layers 632*a* and 632*b* vertically such that recesses 676*a* and 680*a* of such layers, respectively, are substantially aligned. Opening 652*a* can receive one more removable inserts (not shown). Opening 652*b* is similarly formed by aligning mattress layers 632*a* and 632*b* vertically, but in such a manner that recesses 676*b*, 680*b* of such layers, respectively, are not substantially aligned. Opening 652*b* may not be able to receive one or more removable inserts (not shown) depending on how substantially recesses 676*b*, 680*b* are misaligned.

While misaligned recesses are not generally desirable, a manufacturer may nonetheless create layered mattress bodies in a more cost-efficient manner by have a standard manufactured layer, such as foundation layer 632*a*, with recesses, such as recesses 676*a* and 676*b*, cut/formed therein at standard intervals. When assembling the mattress layers, a layer, such as layer 632*a*, may be aligned with another layer, such as layer 632*b*, such that at least some (e.g., the maximum number possible) recesses of the mattress layers are substantially aligned to form openings for receiving one or more removable inserts. In such a configuration, a certain number of openings may nonetheless be created that cannot receive one or more removable inserts, but that loss may be compensated by cost efficiencies gained from having one or more standardized mattress layers, such as layer 632*a*. For example, the standard layer 632*a* can be designed to create the most number of openings with a lower layer 632*b* for the most common or otherwise cost-beneficial size and/or type of mattress body produced. In this way, fewer molds and/or processes need to be made/used to create a mattress, while still capturing the benefits of having a number of user-accessible openings for receiving removable inserts, as described herein.

Opening 652*c* is similar to opening 652*a* in that it is formed from recesses 676*c* and 676*d* of adjacent mattress segments such that it can receive one or more removable inserts. However, opening 652*c* is formed by two horizontally-adjacent mattress segments 636*a*, 636*b* of foundation layer 636. Such horizontally-adjacent mattress layers will generally, but need not necessarily, be affixed by more than just friction (e.g., by laminating). Finally, opening 652*d* is formed directly within segment 636*c* and can receive one or more removable inserts. Some or all of openings 652*a*-652*d* may be formed in any number or variety of mattress layers and on any end or side of such mattress layers, including the embodiments of the mattress layers shown and described with reference to FIGS. 1-13. Similarly, any number of mattress layers may be used and joined in any number of segments (e.g., three) or orientations (e.g., angled) to create embodiments of the mattress bodies disclosed herein, including the embodiments shown and/or described in any of FIGS. 1-13.

The claims are not intended to include, and should not be interpreted to include, means-plus- or step-plus-function limitations, unless such a limitation is explicitly recited in a given claim using the phrase(s) "means for" or "step for," respectively.

What is claimed is:

1. A mattress comprising:

a body having one or more openings formed within portions of a side or and end of the body, the one or more openings configured to receive one or more removable inserts;

a fire-retardant cover that substantially encloses the body, the fire-retardant cover configured to permit access by a mattress user to the one or more openings, and the fire-retardant cover comprising a first closeable slit configured to permit access by a mattress user to the one or more openings;

a second cover that substantially encloses the fire-retardant cover, the second cover configured to permit access by a mattress user to the one or more openings through a second closeable slit aligned with the first closeable slit;

a fire shield configured to be positioned over the first closeable slit, and between the body and the fire-retardant cover or between the fire-retardant cover and the second cover, the fire shield configured to permit access by a mattress user to the one or more openings;

a first fastening device, the first fastening device configured to open and close the first closeable slit; and a second fastening device, the second fastening device configured to open and close the second closeable slit.

2. The mattress of claim 1, further comprising one or more removable inserts positioned within the one or more openings, the one or more removable inserts having different mechanical characteristics than the portions of the body forming the one or more openings.

3. The mattress of claim 2, further comprising at least two removable inserts positioned within a single opening.

4. The mattress of claim 1, wherein the body comprises a top, a bottom, sides, and ends, and the one or more openings can be accessed from at least one of the sides or ends but not from the top or the bottom.

5. The mattress of claim 1, wherein the body further comprises one or more layers, the one or more openings positioned within the one or more layers such that a removable insert can be received within the one or more openings without moving the one or more layers.

6. The mattress of claim 5, wherein the one or more layers comprise a first layer positioned immediately adjacent a second layer and the one or more openings are positioned between the first layer and the second layer.

7. The mattress of claim 1, wherein a mattress user may access the one or more openings to position a removable insert within or remove a removable insert from the one or more openings.

8. The mattress of claim 1, wherein the fire shield extends entirely over the first closeable slit of the fire-retardant cover such that no portion of the mattress body is in direct contact with the first closeable slit of the fire-retardant cover.

9. The mattress of claim 1, wherein the fire shield extends entirely over the first closeable slit of the fire-retardant cover such that no portion of the second cover is in direct contact with the first closeable slit of the fire-retardant cover.

10. The mattress of claim 1, wherein the fire shield is coupled on at least one side to the fire-retardant cover to cover the first closeable slit of the fire-retardant cover and the fire shield is open on at least one side to allow a user to move a portion of the fire shield to gain full access to the openings in the mattress body through the first closeable slit of the fire-retardant cover.

11. A method of forming a mattress comprising:

forming two or more mattress layers for a body of the mattress;

forming openings in a side or an end of the body of the mattress in or between the two or more mattress layers, the openings for receiving one or more removable inserts;

affixing the two or more mattress layers together such that the openings are disposed in the mattress layers and can receive one or more removable inserts without having to move or separate the mattress layers;

substantially enclosing the two or more mattress layers in a fire-retardant cover, the fire-retardant cover configured to permit access by a mattress user to the openings, the fire-retardant cover comprising a first closeable slit in the fire-retardant cover, the first closeable slit configured to permit access by a mattress user to the openings;

substantially enclosing the fire-retardant cover in a second cover comprising a second closeable slit aligned with the first closeable slit, the second closeable slit configured to permit access by a mattress user to the openings, the fire-retardant cover comprising a first fastening device coupled to the first closeable slit, the first fastening device configured to open and close the first closeable slit, and a second fastening device coupled to the second closeable slit, the second fastening device configured to open and close the second closeable slit; and coupling a fire shield over the first closeable slit, and between the body and the fire-retardant cover or between the fire-retardant cover and the second cover, the fire shield configured to permit access by a mattress user to the openings.

12. The method of claim 11, wherein the step of forming openings comprises removing material from at least one of the mattress layers to form the openings.

13. The method of claim 12, wherein the removed material is removed after affixing the two or more mattress layers together.

14. The method of claim 12, further comprising:

removing material from at least two mattress layers, wherein the removed material in each of the two mattress layers creates only portions of one or more openings; and affixing the two mattress layers together such that the portions of openings in each of the two mattress layers align to form openings that can receive one or more removable inserts without having to move or separate the two mattress layers.

15. The method of claim 11, further comprising positioning one or more removable inserts into the openings, the one or more removable inserts having different mechanical characteristics than the material of the mattress layers forming the openings.

16. The method of claim 11, wherein coupling the fire shield comprises coupling the fire shield to extend entirely over the first closeable slit of the fire-retardant cover such that no portion of the mattress body is in direct contact with the first closeable slit of the fire-retardant cover.

17. The method of claim 11, wherein coupling the fire shield comprises coupling the fire shield to extend entirely over the first closeable slit of the fire-retardant cover such that no portion of the second cover is in direct contact with the first closeable slit of the fire-retardant cover.

18. The method of claim 11, wherein coupling the fire shield comprises coupling on at least one side to the fire-retardant cover to cover the first closeable slit of the fire-retardant cover and the fire shield is open on at least one side to allow a user to move a portion of the fire shield to gain full access to the openings in the mattress body through the first closeable slit of the fire-retardant cover.

* * * * *